US009962043B2

(12) United States Patent
Braic et al.

(10) Patent No.: US 9,962,043 B2
(45) Date of Patent: May 8, 2018

(54) SOAP DISPENSER

(71) Applicant: WET HEADS INC., Orangeville (CA)

(72) Inventors: Vito Braic, Orangeville (CA); Robert G. Dickie, King (CA)

(73) Assignee: Wet Heads Inc., Orangeville, Ontario (CA)

( * ) Notice: Subject to any disclaimer, the term of this patent is extended or adjusted under 35 U.S.C. 154(b) by 177 days.

(21) Appl. No.: 14/734,697

(22) Filed: Jun. 9, 2015

(65) Prior Publication Data

US 2015/0351592 A1 Dec. 10, 2015

Related U.S. Application Data

(60) Provisional application No. 62/010,130, filed on Jun. 10, 2014.

(51) Int. Cl.
*A47K 5/12* (2006.01)

(52) U.S. Cl.
CPC ..... *A47K 5/1202* (2013.01); *A47K 5/1214* (2013.01); *A47K 2005/1218* (2013.01)

(58) Field of Classification Search
CPC .. A47K 5/1202; A47K 5/1214; E03C 1/0465; E03C 1/046; B05B 7/2464
USPC .... 4/675, 678; 239/211, 418, 315, 316, 289, 239/380, 628, 302–308, 320, 321; 222/501, 192; 137/801
See application file for complete search history.

(56) References Cited

U.S. PATENT DOCUMENTS

| | | | | |
|---|---|---|---|---|
| 2,245,508 | A * | 6/1941 | Travis | A47K 5/1214 221/135 |
| 4,353,139 | A * | 10/1982 | Wainwright | A47K 3/001 239/211 |
| 5,125,577 | A * | 6/1992 | Frankel | E03C 1/02 239/211 |
| 6,409,099 | B1 * | 6/2002 | Goodwin | B05B 7/2467 239/310 |
| 6,732,956 | B1 * | 5/2004 | Chetrit | A61C 17/02 239/25 |
| 6,827,294 | B1 * | 12/2004 | Fan | A47K 5/1204 222/192 |
| 7,588,197 | B2 * | 9/2009 | Finell | A47K 5/12 222/110 |
| 8,371,514 | B2 * | 2/2013 | Finell | A47K 3/005 239/288 |
| 9,096,995 | B1 * | 8/2015 | Al-Qaneei | E03C 1/0465 |
| 2004/0069802 | A1 * | 4/2004 | Frankel | B05B 1/1627 222/144.5 |

* cited by examiner

*Primary Examiner* — Erin Deery
(74) *Attorney, Agent, or Firm* — Sand & Sebolt

(57) ABSTRACT

A soap dispenser that is engaged to the aerator threads on a faucet. When the faucet is switched on, water flows through a first pathway in the dispenser and exits the dispenser through an opening on the lower front of the device. The dispenser includes a separate second pathway which holds a quantity of liquid soap. A roller assembly provided on the dispenser controls the flow of soap from the second pathway. A graphic image of a face aesthetically pleasing to children may be provided on the front of the housing. The graphic image is positioned so that the opening through which water flows forms the mouth of the face. A trough member in the first pathway smooths the water flow so that water flowing out of the opening takes on the appearance of a tongue sticking out of the mouth of the face.

13 Claims, 19 Drawing Sheets

SOAP DISPENSER

CROSS-REFERENCE TO RELATED APPLICATION

This application claims the benefit of U.S. Provisional Patent Application Ser. No. 62/010,130, filed Jun. 10, 2014, the entire specification of which is incorporated herein by reference.

BACKGROUND OF THE INVENTION

Technical Field

This invention is directed generally to soap dispensers. More particularly, this invention relates to a soap dispenser that is highly suitable for use by younger children. Specifically, the invention is a soap dispenser that is engageable on a standard household faucet so that the dispenser is easily accessed and wherein the dispenser is configured to separately dispense water and soap therefrom.

Background Information

Parents and caregivers try to encourage children in the care to develop healthy habits. One of the areas that may be challenging to teach and reinforce is washing hands after a range of activities. It has long been known that hand washing aids in preventing the spread of disease. Children frequently resist washing their hands as this activity seems to be tedious and unnecessary when there are so many more fun and exiting things to do. Even if they do comply and wash their hands, they frequently only want to run their hands under water and not use soap.

Soap dispensers, including those made specifically for children, typically stand on bathroom counters or sinks or they may be mounted on a wall adjacent the sink. These dispensers typically include some type of pump that has to be depressed in order to dispense a quantity of soap. Applying sufficient pressure to these pumps may be difficult for children, particularly younger children.

SUMMARY

The soap dispenser disclosed herein provides a fun, convenient and easy to use device that may encourage children to wash their hands using soap and water. The dispenser is directly attached to a faucet and hangs downwardly therefrom and over the sink. Water flowing from the faucet is forced to flow through the dispenser and out of an opening in the front wall thereof and into the sink.

In order to dispense soap from the dispenser, the child simply has to push lightly upwardly on a roller ball provided on the bottom wall of the dispenser. The slight upward movement shifts the roller ball off its seat and allows a small quantity of liquid soap to flow past the roller ball from a soap-retaining pathway within the dispenser and onto the child's hands. Because very little upward force is required to shift the roller ball, even fairly young children are easily able to dispense soap into their hands.

Additionally, the surface of the dispenser facing the child may be provided with an aesthetically pleasing graphic image in the form of a face. The face is positioned so that water flowing from the faucet flows out of the "mouth" on the face. The laminar flow generated by an interior surface of the dispenser causes the water flowing out of the same to have the appearance of a tongue. So, when the faucet is switched on the face appears to be sticking their tongue out at the child. Consequently, the dispenser makes it fun to wash hands because of the pleasing image of the "face", the fact that water flows out of a mouth region of that "face", and that the child may be able to dispense soap into their hands all by themselves.

Other decorative components may be provided on the exterior surface of the dispenser's housing instead of a face. In other instances, the housing itself may be molded so as to have an exterior shape different to that illustrated in the attached figures. For example, the entire housing may be configured to have the shape of an animal or of a character such as a cartoon character to make the dispenser more aesthetically pleasing to a child.

It will be understood that in other instances the exterior surface of the dispenser may be configured so that the dispenser is more appealing to an adult than a child. The provision of a roller ball on the bottom wall of this differently decorated dispenser will make it easy for older children and adults to dispense liquid soap from the dispenser with minimal effort.

In one aspect, the soap dispenser may be directly engaged with the aerator threads on a standard bathroom or kitchen faucet so that it is always ready for use. When the faucet is switched on, water flows through a first pathway in the dispenser and exits the dispenser through an opening in the lower region of the front wall of the device. The dispenser includes a separate second pathway which holds a quantity of liquid soap therein. A roller assembly provided on the dispenser controls the flow of soap from the second pathway. As indicated above, a graphic image of a face aesthetically pleasing to children may be provided on the front of the housing. The graphic image may be positioned so that the opening through which water flows forms the mouth of the face. A trough member in the first pathway smooths the water flow so that water flowing out of the opening may take on the appearance of a tongue sticking out of the mouth of the face. The dispenser is able to separately dispense water and soap on demand. While the soap may be dispensed by the child themselves, for younger children an adult may regulate the water flow through the dispenser by controlling the faucet.

In another aspect, the invention may provide a soap dispenser which is engaged on a faucet such that water from the faucet is able to flow through the dispenser when the faucet is switched on, and wherein the soap dispenser is configured to separately deliver water and soap to a user through separate openings in the dispenser.

In another aspect, the invention may provide a soap dispenser including a housing; a first pathway through the housing; where the first pathway is adapted to permit water to flow therethrough; and a second pathway through the housing; where the second pathway is adapted to permit soap to flow therethrough. The soap dispenser may further provide a first opening and a second opening defined in the housing, wherein the first opening, is at a first end of the first pathway and the second opening is at the second end of the first pathway. The soap dispenser may further provide a third opening and a fourth opening defined in the housing; where the third opening is at a first end of the second pathway and the fourth opening is at the second end of the second pathway.

In another aspect the invention may provide a roller assembly provided to selectively block the fourth opening; and wherein the roller assembly is adapted to control the flow of liquid soap from the second pathway.

In yet another aspect the soap dispenser may comprise a housing that defines a compartment therein; and a bottle is selectively receivable in that compartment; wherein a first pathway is defined between a section of an exterior surface of the bottle and an interior surface of the housing; and the wall of the housing defines a first opening and a second opening therein that are spaced from each other; and wherein the first and second openings provide access to the first pathway; and the first opening is selectively placed in fluid communication with a water pipe engaged with a faucet; and water from the water pipe is selectively caused to flow through the first pathway.

In a still further aspect, the bottle may define a second pathway therein that is adapted to receive a quantity of liquid soap; the wall of the housing may define an additional opening that is spaced from the first and second openings; the bottle defines an aperture that is in fluid communication with the second pathway and is selectively alignable with the additional opening in the housing. A roller assembly is selectively positionable adjacent the aperture in the bottle and the additional opening; and said roller assembly selectively controls the flow of liquid soap out of the second pathway through the aperture and out of the additional opening in the housing.

In yet another aspect, the part of the bottle's exterior surface which defines one part of the first pathway is curved and is adapted to smooth the flow of water therealong and out of the second opening.

In another aspect, the invention may provide a method of dispensing soap or water to a user comprising the steps of engaging a dispenser housing onto an end of a faucet; positioning a user's hands beneath a bottom wall of the dispenser to dispense a quantity of soap into the same; contacting a roller ball extending from the bottom wall of the dispenser with the user's hand or hands; pushing the roller ball upwardly toward a top end of the housing; dispensing a first quantity of soap past the roller ball from a soap-containing pathway defined within the housing and into the user's hands; and moving the user's hands downwardly when sufficient soap has been dispensed into the same.

The method may further include switching on the faucet to dispense a quantity of water from the dispenser; positioning the user's hands adjacent an opening in a front wall of the dispenser; allowing water to flow onto the user's hands from a first pathway in the dispenser; and switching off the faucet when sufficient water has been dispensed therefrom.

The method may further include moving a latching mechanism on the housing from a latched position to an unlatched position; pivoting first and second parts of the housing away from each other; inserting a soap-filled bottle into an interior compartment defined by the housing; pivoting the first and second parts of the housing toward each other; and then moving the latching mechanism from the unlatched position to the latched position.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 3:
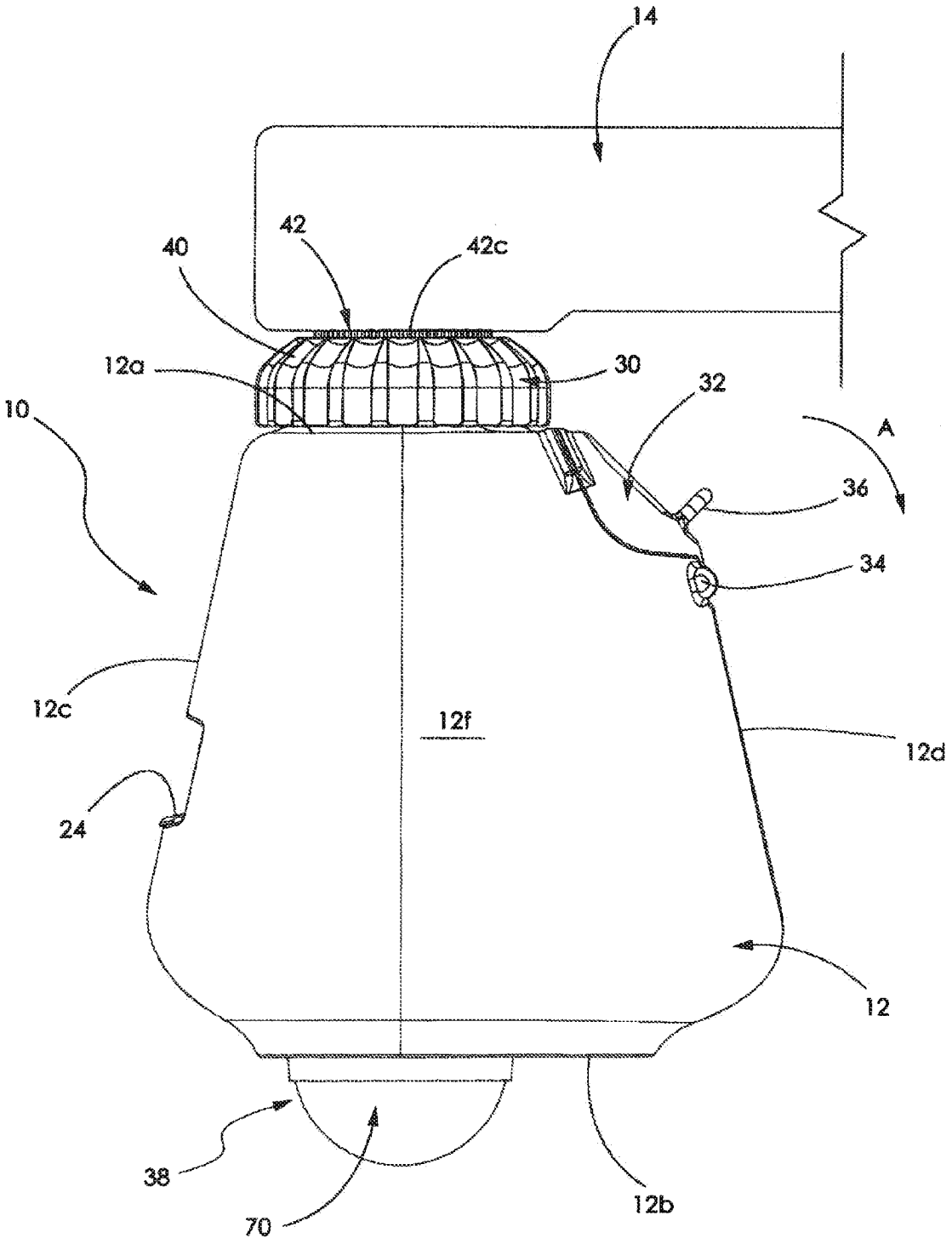
FIG. 3 is a left side elevational view thereof.
Figure 4:
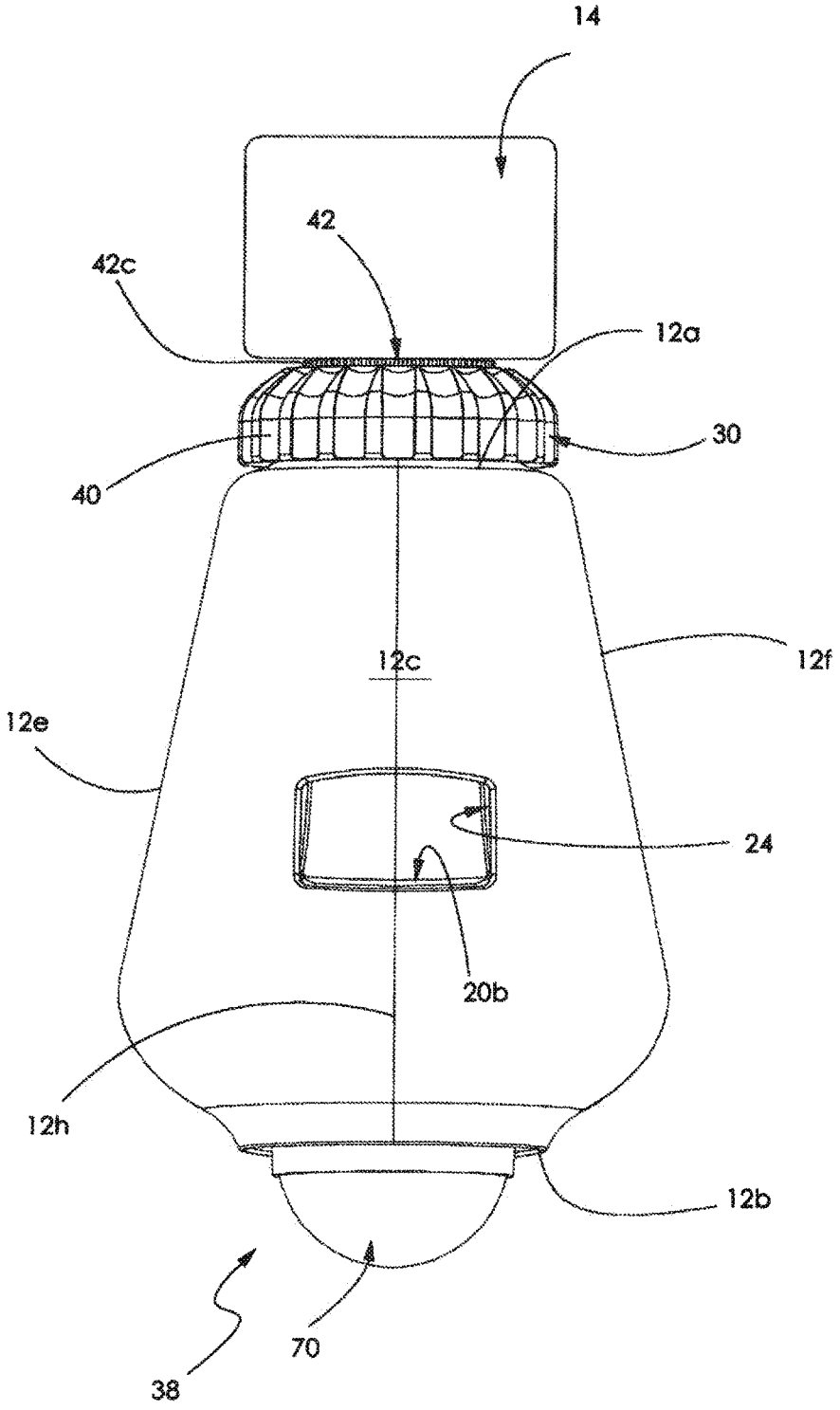
FIG. 4 is a front elevational view thereof.
Figure 5:
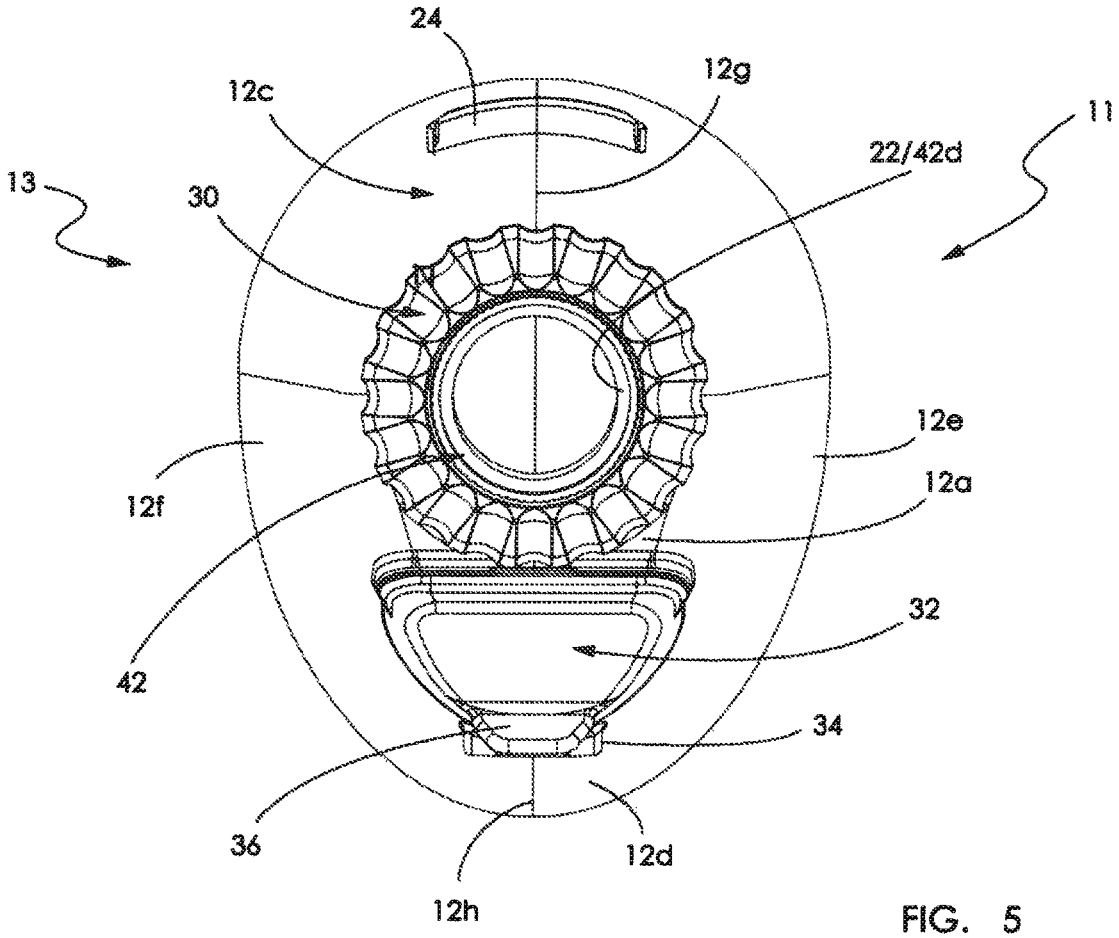
FIG. 5 is a top view thereof.
Figure 6:
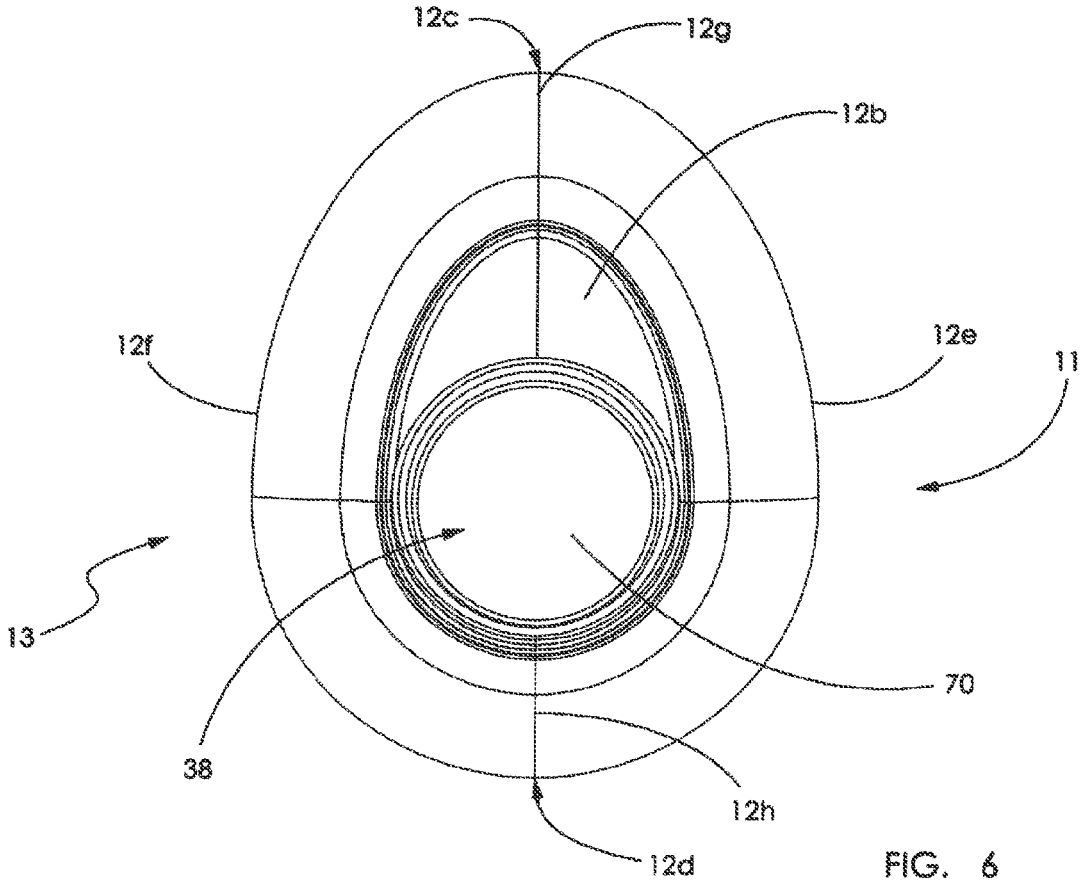
FIG. 6 is a bottom view thereof.
Figure 7:
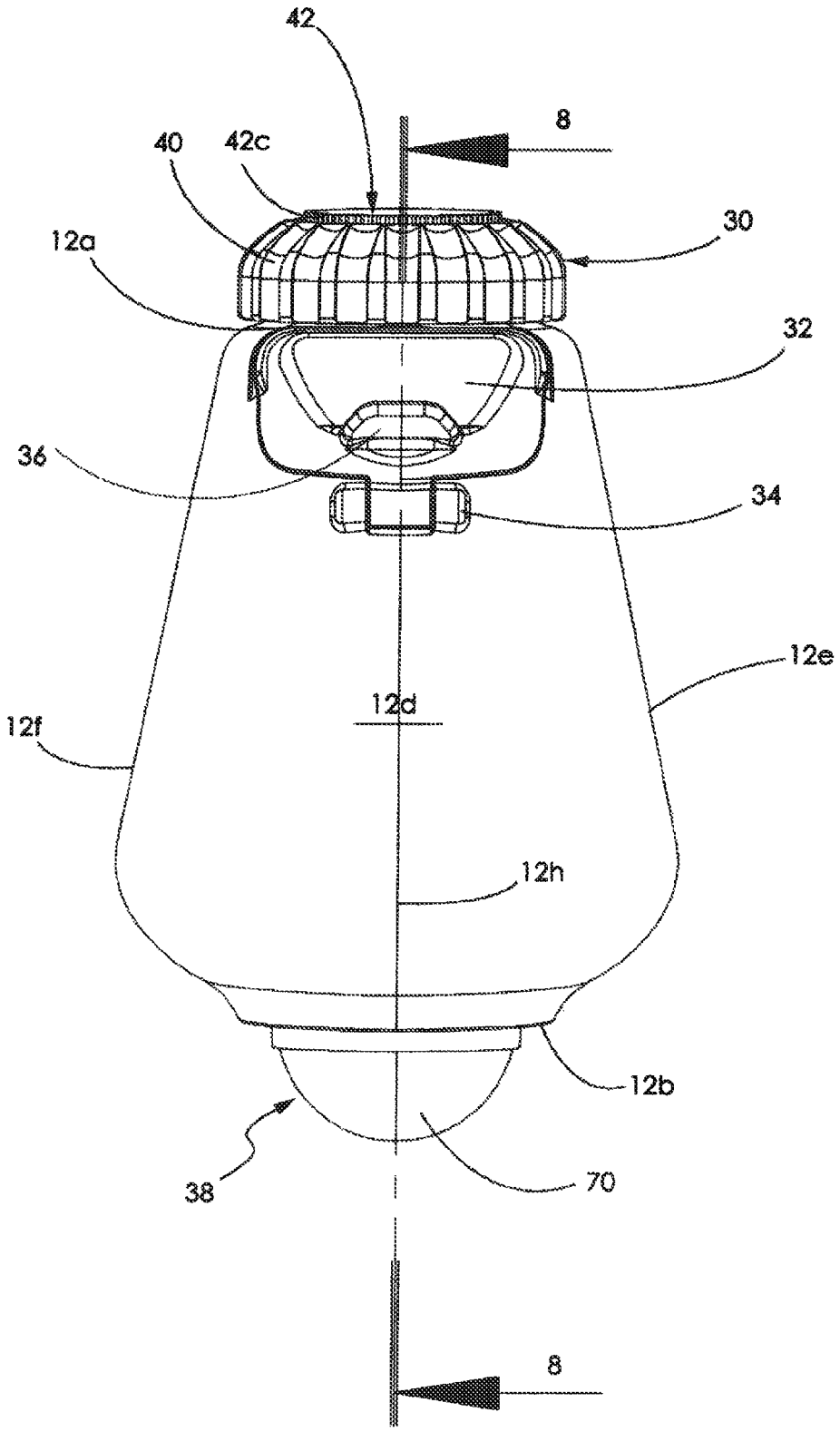
FIG. 7 is a rear elevational view thereof.
Figure 9:
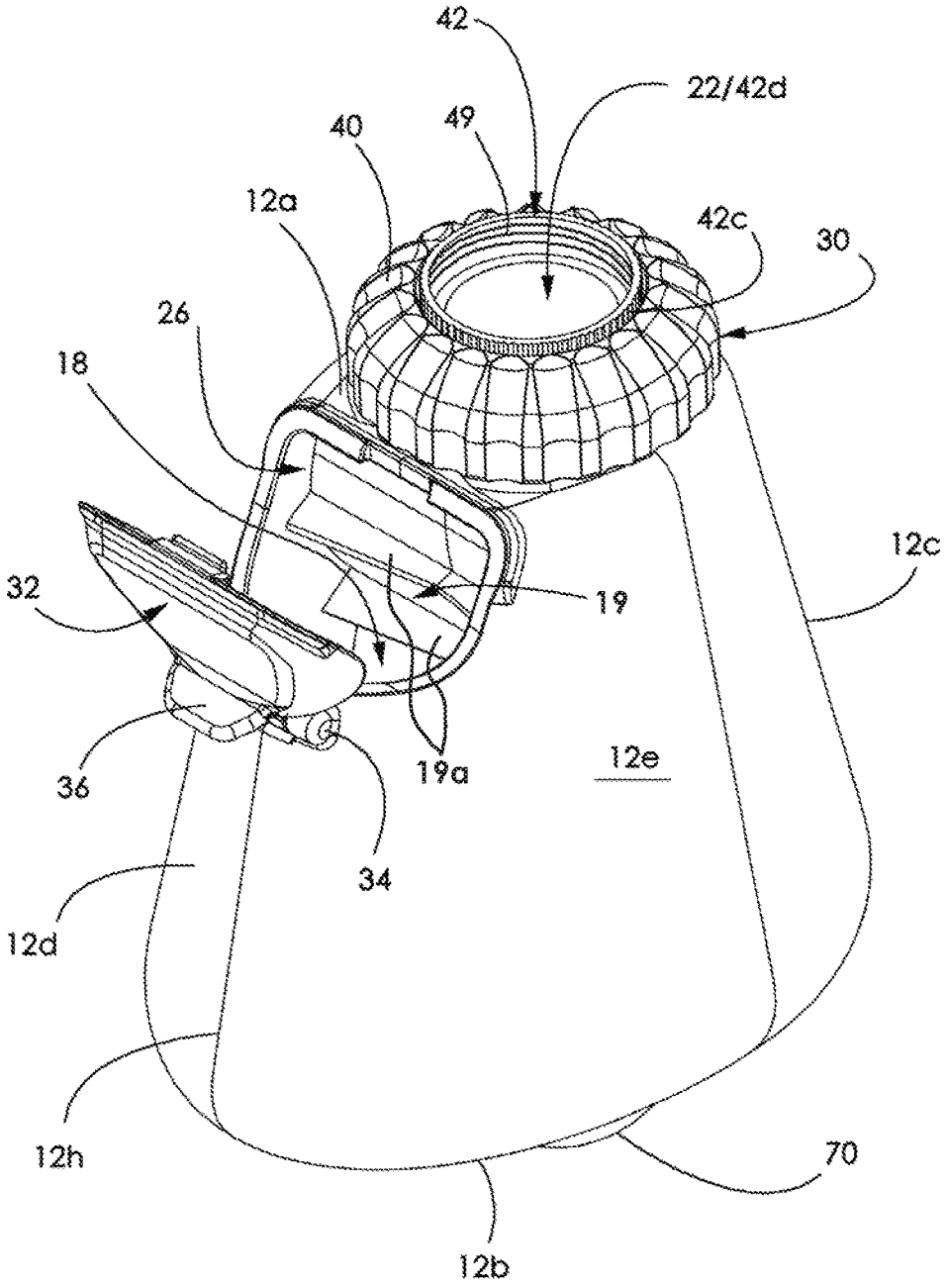
FIG. 9 is a second perspective view of the soap dispenser with the door to the second pathway in an open position.
Figure 10:
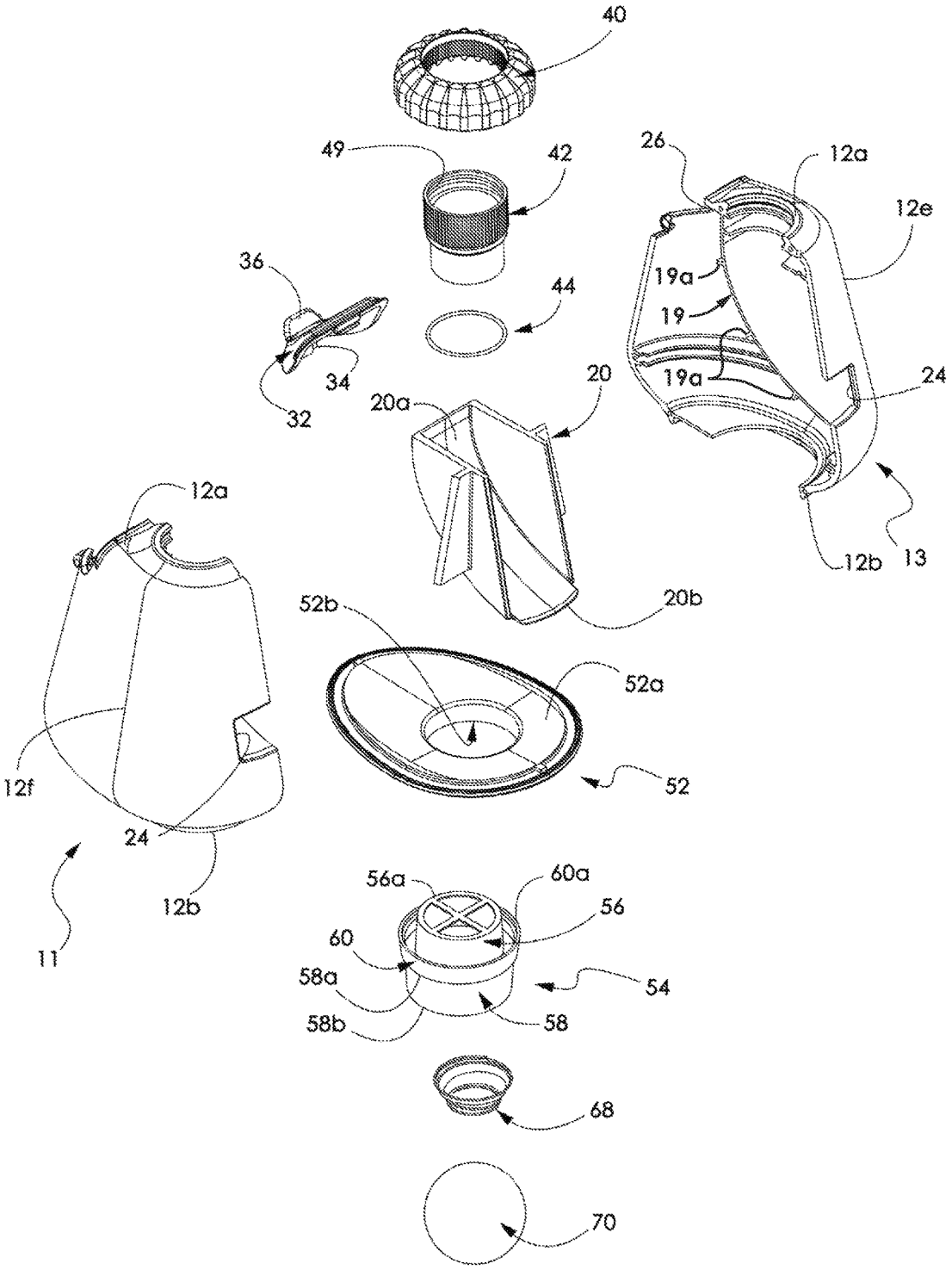
FIG. 10 is an exploded view of the soap dispenser.

Referring to FIGS. 1-16, there is shown a first embodiment of a soap dispenser in accordance with an aspect of the invention, with the dispenser being generally indicated at 10. Dispenser 10 comprises a housing 12 that may be selectively directly attachable to a faucet 14 (FIG. 3). As shown in FIG. 10, housing 12 may be fabricated from two halves that are substantially mirror images of each other. Each of the first half 11 and second half 13 may be molded to form one half of the various openings and pathways provided on housing 12, as will be hereinafter described. The first and second halves 11, 13 may be joined together in any suitable way, such as by sonic welding for example. The joints between the first and second halves form mid-lines 12*g*, 12*h* on housing 12. As best seen from additional joints illustrated in FIGS. 5 and 6, first and second halves 11, 13 may themselves be fabricated from two or more components that are suitably secured together, such as by sonic welding.

Housing 12 may be of any desired overall shape and may include a top wall 12*a*, a bottom wall 12*b*, a front wall 12*c*, a rear wall 12*d*, a left side 12*e*, and a right side 12*f*. The walls 12*a*-12 bound and define an interior space that is separated into a first pathway 16 and a second pathway 18 by a dividing wall 19. The dividing wall 19 includes a ramp member provided on the housing and with which a trough member 20 is engaged. The ramp and the related trough member are of a particular curved shape. Trough member 20 has an upper region 20*a* and a lower region 20*b* and is curved therebetween. The curvature of trough member 20 is such that the member is concave in first pathway 16 and convex in second pathway 18. The curvature of trough member 20 is such that water flowing through first opening 22 will slide down the slope of member 20 and become less turbulent or smoother. Lower region 20*b* of trough member 20 forms a bottom wall of those surfaces of housing 12 which define second opening 24. The shape of trough member 20 is such that it aids in directing and calming the water flow through second opening 24 to the degree that the water may flow smoothly outwardly from second opening 24. The smoothly flowing water may take on the appearance of a tongue, as will be described later herein. The back wall of trough member 20 inside second pathway 18 includes a plurality of projections 19*a* which extend outwardly therefrom. These projections 19*a* may be seen in FIG. 8 and FIG. 9.

A first opening 22 is defined in top wall 12*a* of housing 12. First opening 22 is in fluid communication with first pathway 16 and provides access thereto. Front wall 12*c* defines a second opening 24 therein. Second opening 24 is also in fluid communication with first pathway 16 and provides access thereto. Second opening 24 may be located proximate bottom wall 12*b* of housing 12. Trough member 20 extends from adjacent first opening 22 to adjacent second opening 24. Thus, when housing 12 is engaged with faucet 14, first opening 22, first pathway 16 and particularly the trough member 20 therein, and second opening 24 form a channel through which water can flow through housing 12 from faucet 14 through to the user.

A third opening 26 is defined in back wall 12*d* of housing 12. Third opening 26 may be positioned proximate top wall 12*a*. Third opening 26 is in communication with second pathway 18 and provides access thereto. A fourth opening 28 is defined in bottom wall 12*b*. Fourth opening 28 is in communication with second pathway 18 and provides access thereto. Thus, third opening 26, second pathway 18, and fourth opening 28 form a second channel through housing 12 and through which liquid soap is able to flow.

Figure 12:
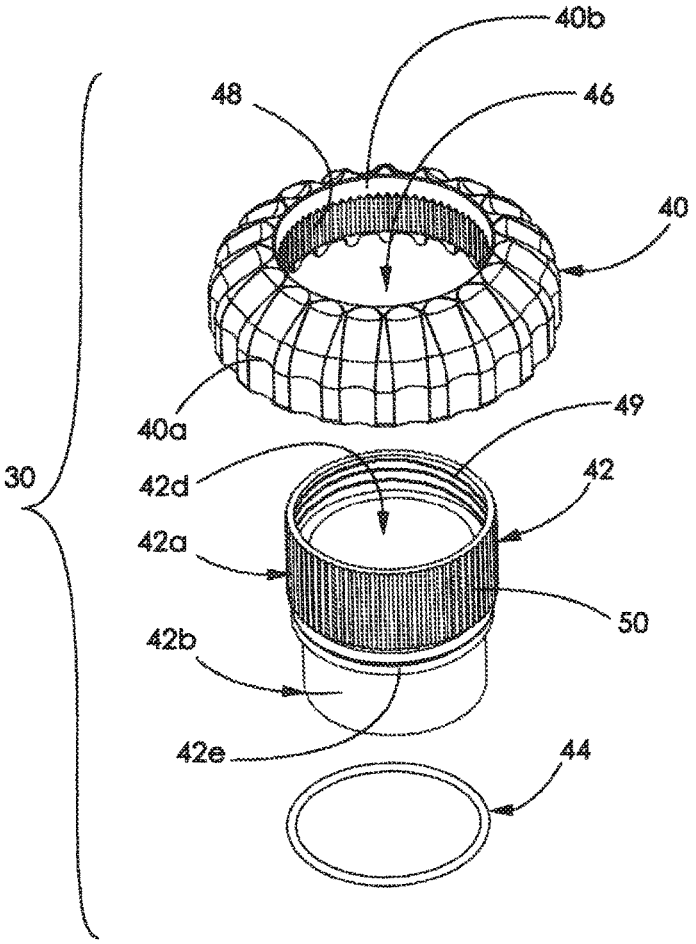
FIG. 12 is an exploded view of connector assembly.

A connector assembly 30 is engaged with housing 12 proximate first opening 22. Connector assembly 30 is configured to be able to secure housing 12 to faucet 14. As best seen in FIGS. 10 and 12, connector assembly 30 may comprise a connector ring 40, an aerator 42, and an O-ring 44. Connector ring 40 and aerator 42 may be fabricated out of brass so that they are durable and make a good and solid connection to faucet 14.

Connector ring 40 has a peripheral wall 40*a* that may be provided with knurling or some other type of frictional surface which aids the user when gripping the ring 40. An aperture 46 is bounded and defined by an interior surface of peripheral wall 40*a* and the interior surface thereof may be provided with threads 48. Threads 48 do not necessarily extend for the entire depth of aperture 46 and a smooth annular region 40*b* may be provided toward the top end of connector ring.

Aerator 42 is engaged with connector ring 40. Aerator 42 may be an off-the-shelf item, i.e., a standard aerator typically used in bathroom or kitchen faucets, and may include a wider upper region 42*a* and a narrower lower region 42*b*. Upper region 42*a* may be complementary in diameter to the aperture 46 defined in connector ring 40. Upper region 42*a* includes threads 50 that may be configured to matingly engage threads 48 on connector ring 40. The mating engagement of these threads 50, 48 permits ring 40 and aerator 42 to be engaged with each other and to move in unison as though they were a single component.

It should be noted that the orientation of threads 50, 48 may be horizontal or vertical or at any other desired angle. It should further be understood that aerator 42 and ring 40 may be connected together by components other than threads 48, 50. Any suitable features provided on aerator 42 and ring 40 or components engaged therewith may be utilized to cause the aerator and ring to be engaged with each other and to move together.

Aerator 42 may furthermore include two different sets of threads, one to engage connector ring 40 and another to engage threads 14*a* (FIG. 14) on a faucet 14. The second set of threads for engaging threads 14*a* on faucet 14 will be suitably located on aerator 42 so as to match the positioning of threads 14*a* on faucet. Thus, as illustrated in the attached figures, aerator 42 is provided with threads 49 on the interior surface of aerator 42 defining bore 42*d*. These threads 49 are located so as to be able to engage an externally threaded region of faucet 14. Alternatively, threads may be provided around the top region 42*c* of aerator 42 to engage an internally threaded aperture on faucet 14.

Figure 1:
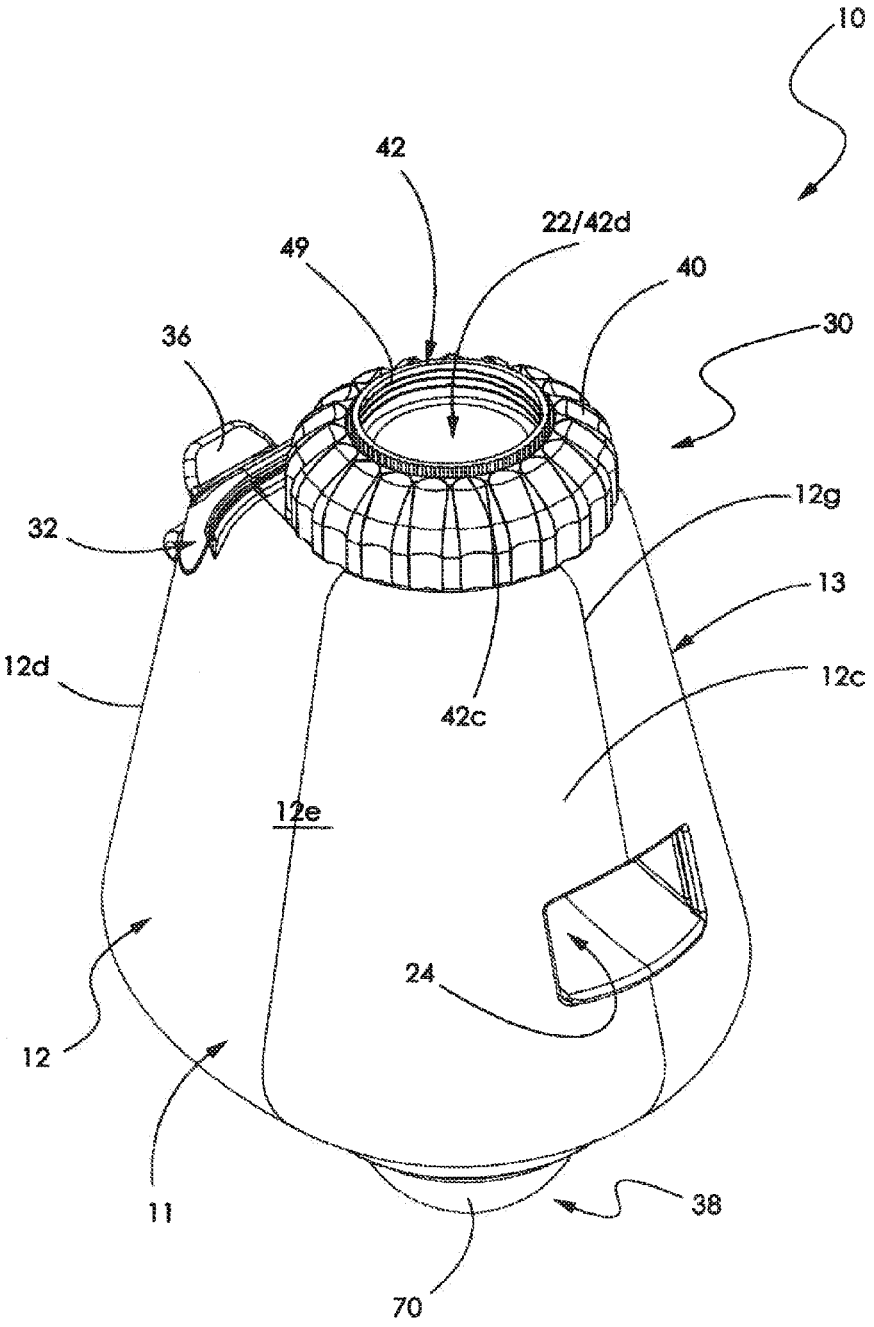
FIG. 1 is a first perspective view of a soap dispenser in accordance with an aspect of the invention.
Figure 2:
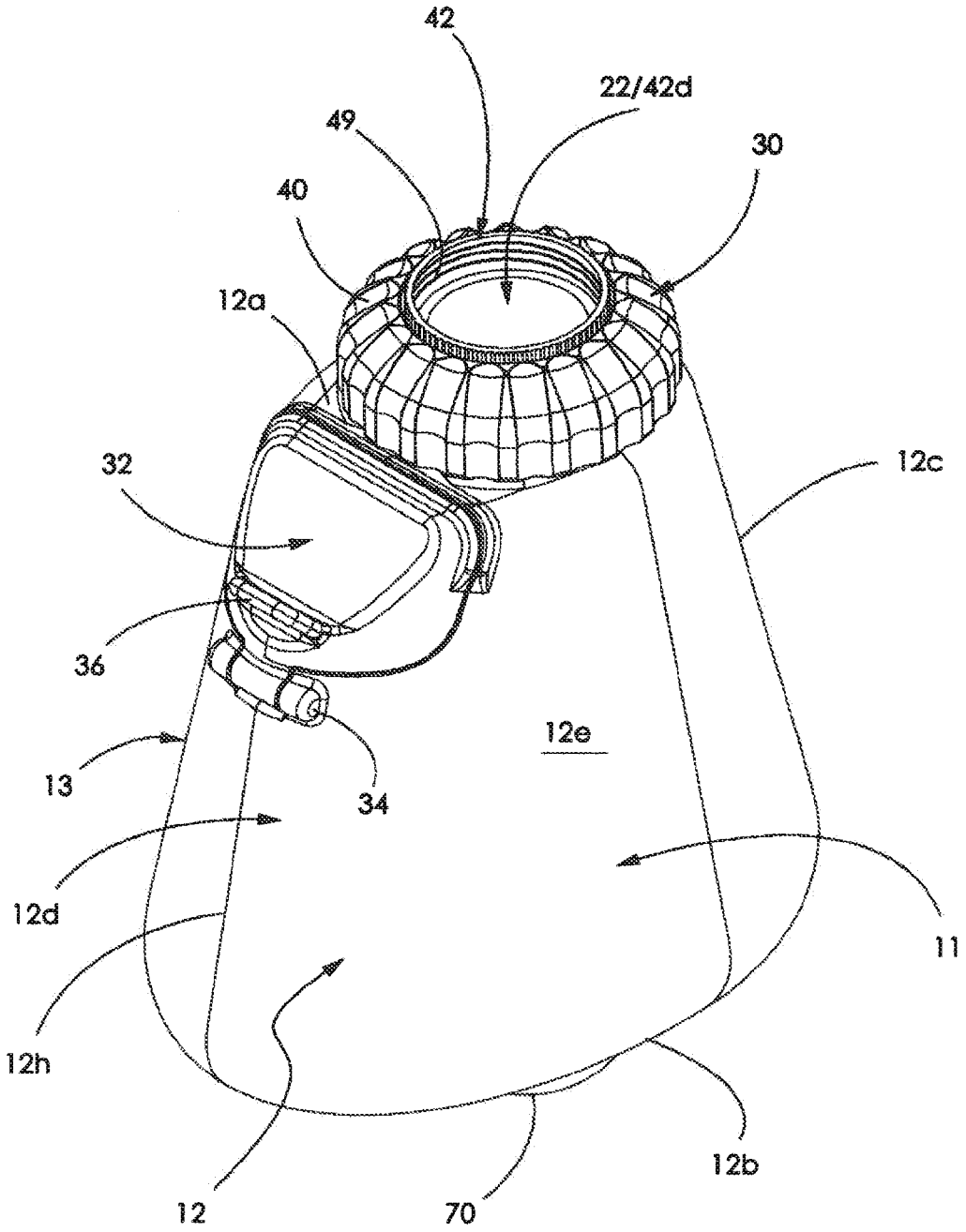
FIG. 2 is second perspective view of the soap dispenser.

The depth of upper region 42*a* of aerator 42 may be greater than the depth of connector ring 40. Consequently, when connector ring 40 engages aerator 42, a portion of aerator 42 may extend beyond the top end of connector ring 40. This portion is illustrated in FIG. 1 as region 42*c* that protrudes outwardly beyond the top end of connector ring 40. Threads provided on the exterior surface of region 42*c* are utilized to screw aerator 42 and thereby connector assembly 30 and consequently housing 12 to an interiorly threaded aperture on faucet 14.

Figure 14:
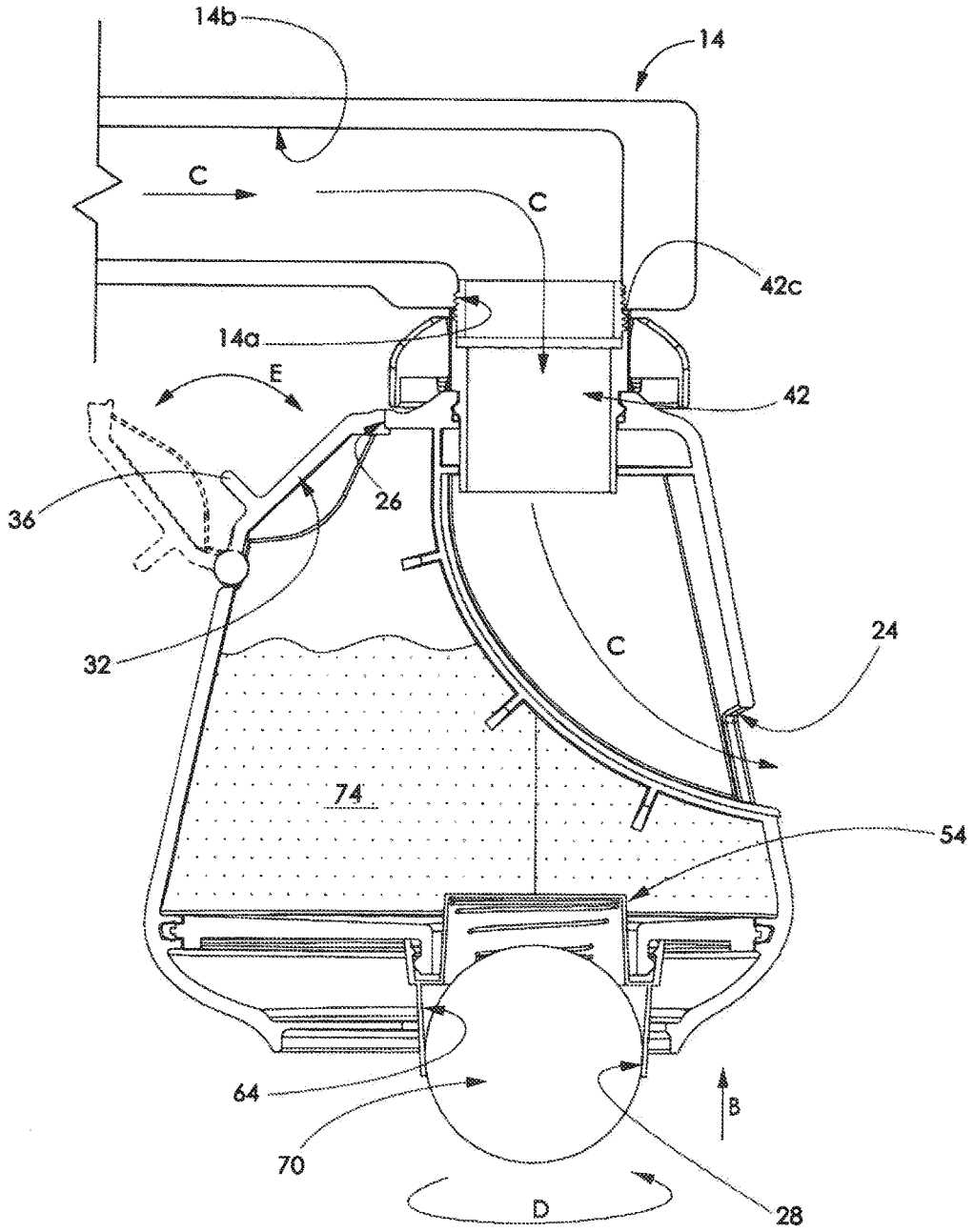
FIG. 14 is a cross-section of the soap dispenser engaged with a faucet and with the roller ball positioned to close off the opening in the bottom of the housing.
Figure 15:
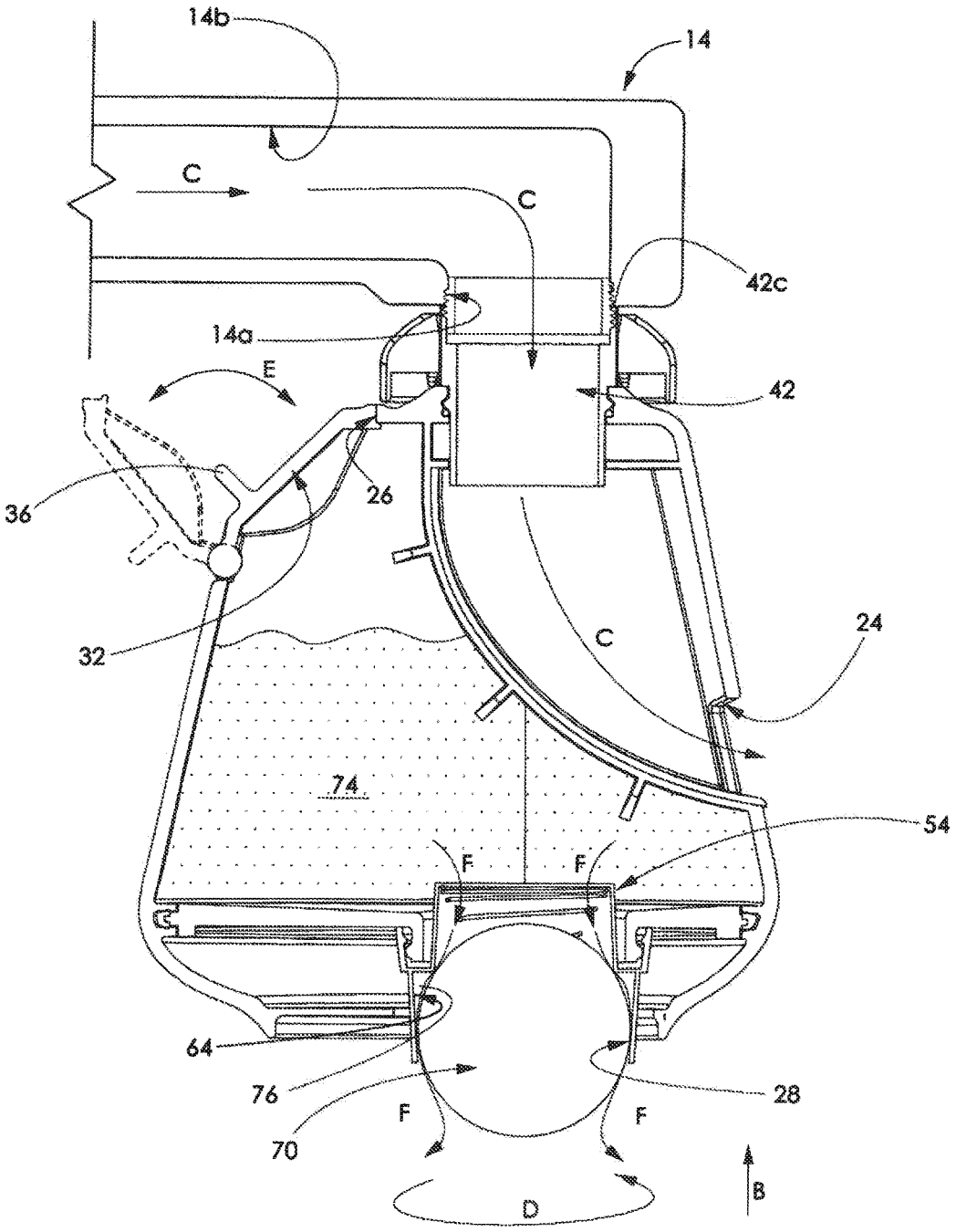
FIG. 15 is a cross-section of the soap dispenser engaged with the faucet with the roller ball positioned to allow a quantity of liquid soap to flow out of the second pathway and through the opening in the bottom of the housing.
Figure 16:
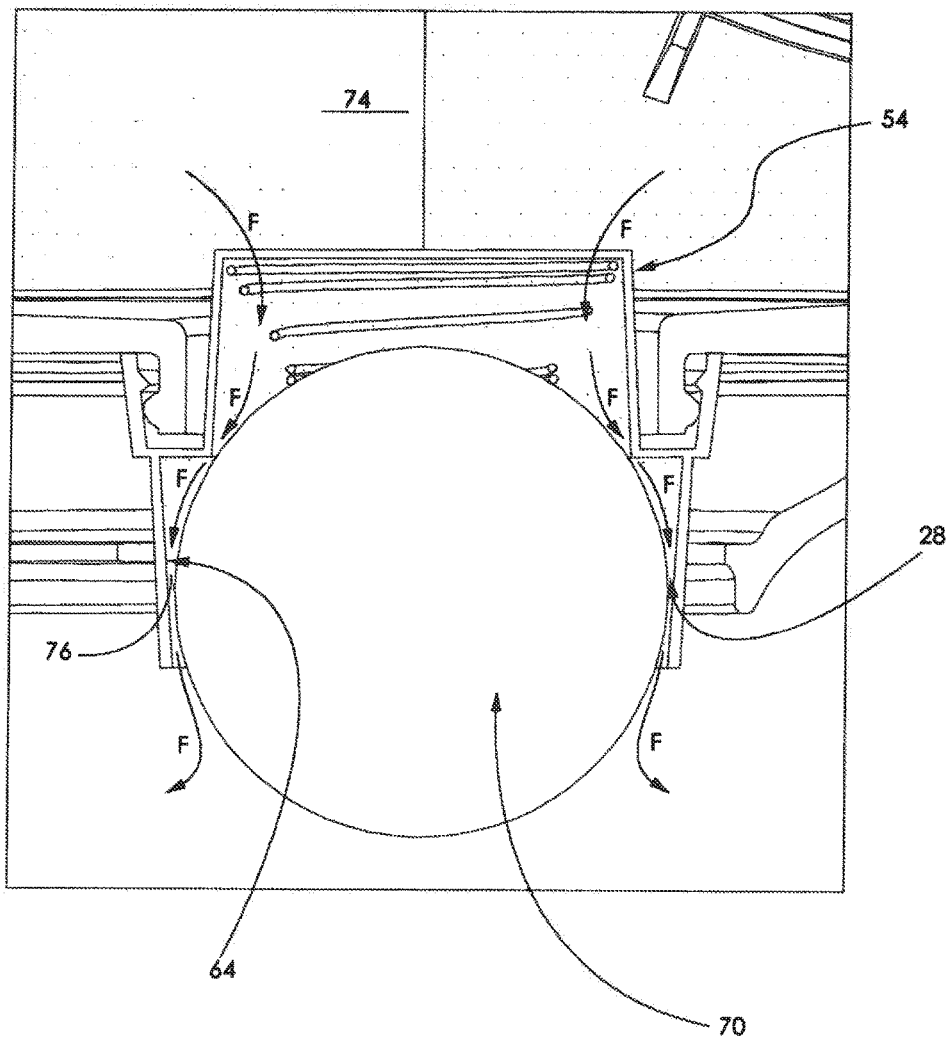
FIG. 16 is an enlarged cross-section of the ball assembly of the soap dispenser.

In order to engage threads 49 on aerator 42 with threads 14*a* on faucet 14, connector ring 40 is rotated in a first direction, such as the direction indicated by arrow "D" (FIG. 14). Since connector ring 40 and aerator 42 are operatively engaged with each other via threads 50, 48; rotation of ring 40 in the first direction causes aerator 42 to move in the first direction in unison with ring 40 and thereby become threadingly engaged with threads 14*a* on faucet 14. The rotation of connector ring 40 is continued until housing 12 is securely attached to faucet 14. When it is desired to disengage soap dispenser 10 from faucet 14, connector ring 40 is rotated in a second direction, i.e., in a direction opposite to arrow "D". The motion of ring 40 is passed on to aerator 42 which will then unscrew threads 49 on aerator 42 from threads 14*a* on faucet 14.

Aerator 42 defines a bore 42*d* (FIG. 12) therethrough which effectively forms the first opening 22 to housing 12. The transition between upper and lower regions 42*a*, 42*b* of aerator 42 also defines a lip 42*e*. An O-ring 44 is seated against lip 42*e* and is provided around lower region 42*b* of aerator 42 to help seal aerator to housing 12 (see FIG. 8). While O-ring 44 seals aerator 42 to housing 12, ring 44 is configured to permit aerator 42 to turn about an axis running through bore 42*d* and relative to the rest of housing 12. Aerator 42 has to be able to turn in this manner in order to screw it into and out of engagement with threads 14*a* on faucet 14 without requiring housing 12 to rotate in unison therewith. Housing 12 is conversely also able to rotate relative to aerator 12. This enables the user to engage dispenser 10 on faucet 14 and then rotate housing 12 relative to aerator 42 so that either second opening 24 or door 32 is facing outwardly toward the user. Housing 12 will be rotated through 180° to provide access to a door 32 (described below) when it is needful to fill second pathway 18 with liquid soap. When that has been done, housing 12 will be rotated through 180° in the opposite direction so that second opening 24 will, one again, face outwardly toward the user. Soap dispenser 10 is then ready for use to dispense water and/or soap as needed.

Door 32 is engaged with back wall 12*d* of housing 12 by way of a pivot rod 34. Pivot rod 34 allows door 32 to be moved between a closed position (FIG. 2) and an open position (FIG. 9). Door 32 includes a finger-rest 36 that is oriented generally at right angles to door 32. The user will place a finger or thumb on finger-rest 36 and apply pressure in the direction of arrow "A" (FIGS. 3 and 8) to rotate door 32 from a closed position to an open position. Engaging door 32 and applying pressure thereto in the opposite direction to arrow "A" will move door 32 from the open position to the closed position.

Figure 8:
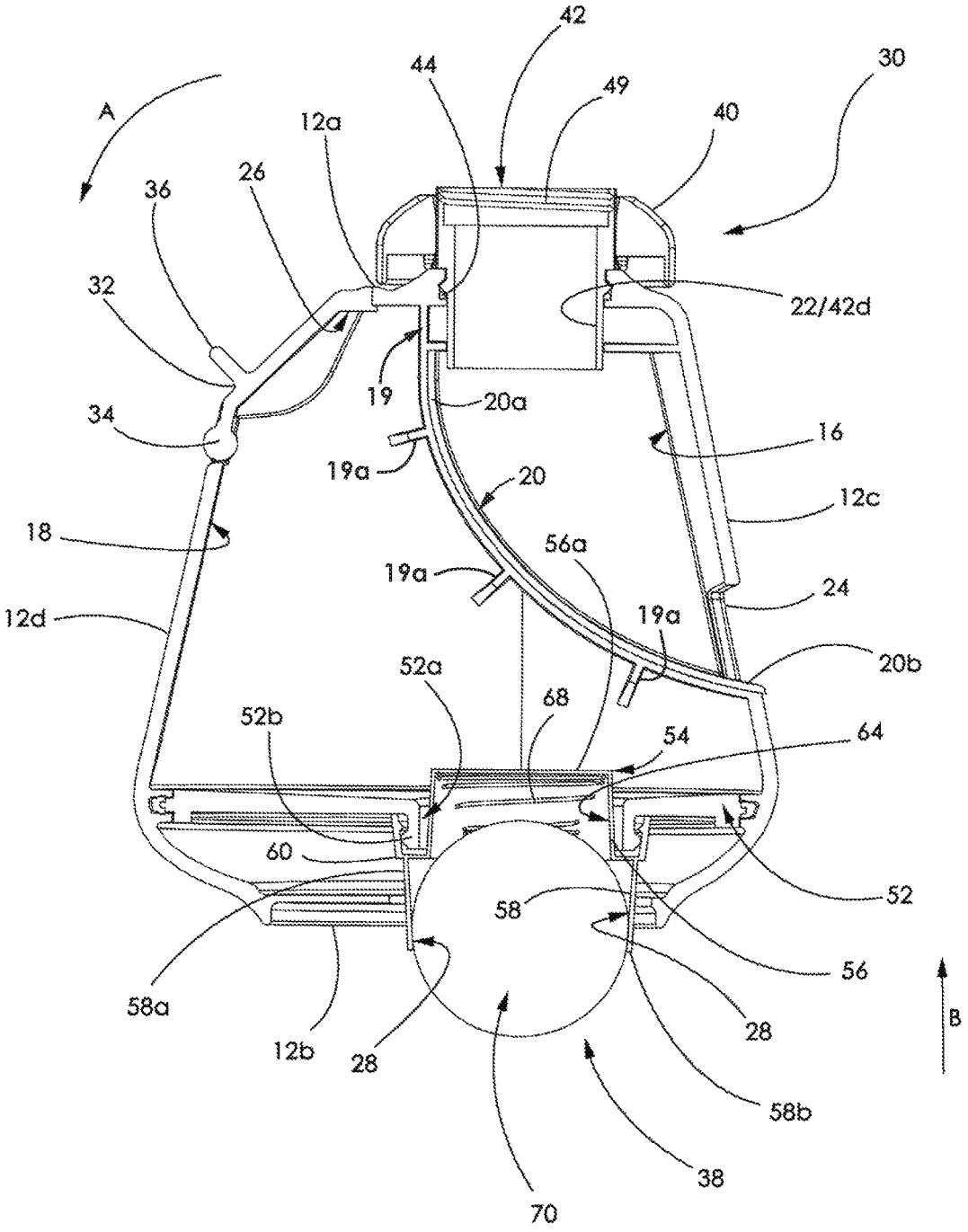
FIG. 8 is a cross-section of the soap dispenser taken along line 8-8 of FIG. 7.
Figure 11:
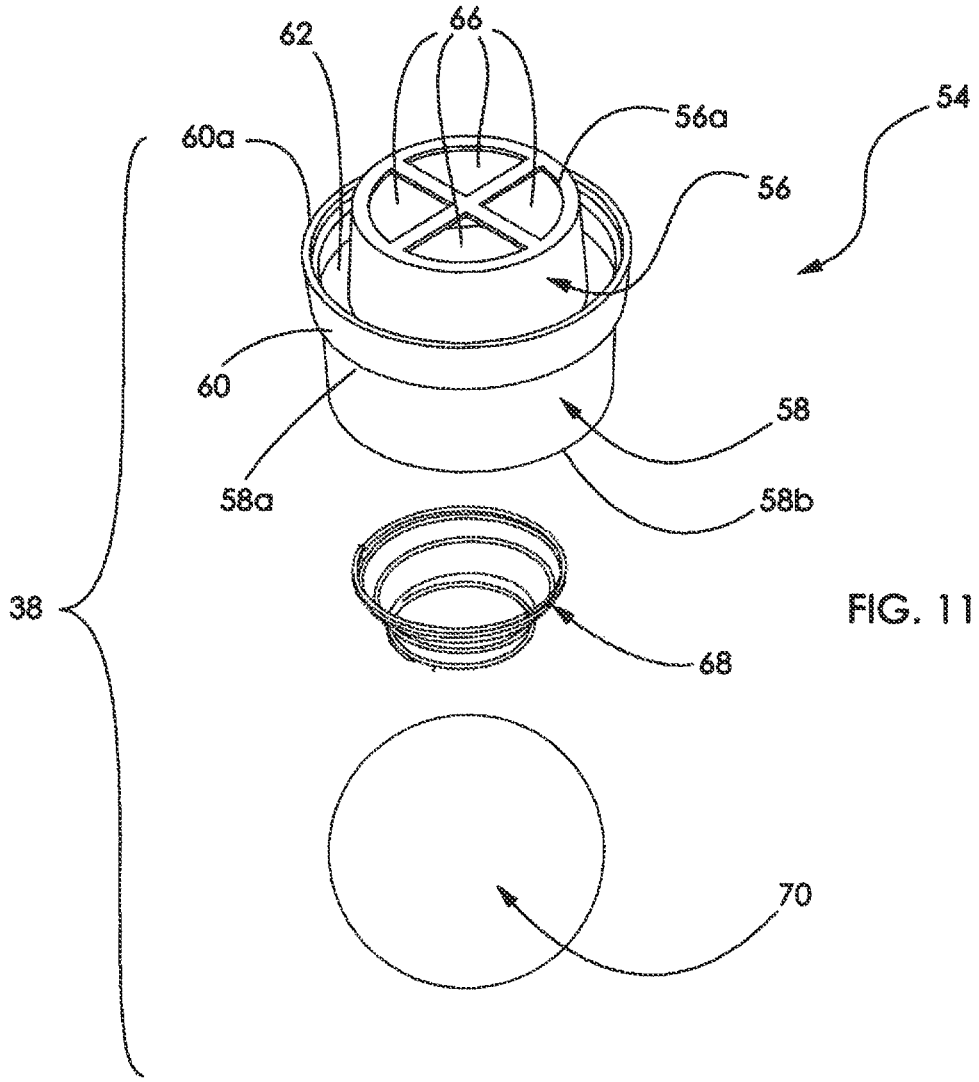
FIG. 11 is an exploded view of the roller ball assembly.

Referring to FIGS. 8, 10 and 11, a roller assembly 38 is provided adjacent fourth opening 28 in housing. Housing 12 includes a floor 52 which is spaced a distance inwardly from bottom end 12*b* of housing 12. Floor 52 defines an aperture 52*a* (FIG. 8) therein. An annular ring 52*b* extends downwardly from a lower surface of floor 52 and engages a ball socket 54 of roller assembly 38. Ball socket 54 is a generally cylindrical member which includes an upper region 56, a lower region 58, and a middle region 60. Upper region 56 originates at an upper end 56*a* and terminates proximate an upper end 58*a* of lower region 58. Middle region 60 is concentric with upper region 56 and is spaced a distance outwardly therefrom so that an annular channel 62 is defined therebetween. A bottom wall bounding channel 62 is substantially aligned with upper end 58*a* of lower region 58. Middle region 60 has an upper end 60*a* which is spaced a distance downwardly from upper end 56*a* of upper region 56 and upwardly from upper end 58*a* of lower region 58. Lower region 58 terminates in a bottom end 58*b*.

Ball socket 54 defines a bore 64 therein which extends from upper end 56*a* through to bottom end 58*b*. Bore 64 may not be of a constant diameter from upper end 56*a* through to bottom end 58*b*. As may be seen in FIG. 8, bore 64 may flare outwardly from upper end 56*a* through to upper end 58*a* of lower region 58. Bore 64 tapers from upper end 58*a* of lower region 58 to bottom end 58*b* thereof. Bore 64 may be widest proximate upper end 58*a* of lower region 58. Upper end 55*a* defines a plurality of holes 66 therein which are in fluid communication with bore 64.

A spring 68, possibly fabricated from stainless steel, is received in the portion of bore 64 defined by upper region 56. A roller ball 70 is received partially within a portion of the bore 64 defined by upper region 56 and partially within a portion of the bore 64 defined by lower region 58. Roller ball further protrudes partially through fourth opening 28 in housing 12. Ball 70 is captured within ball socket 54 but is reciprocally movable therein. Ball 70 is able to be pushed upwardly in the direction of arrow "B" (FIGS. 8 and 14) to allow a substance retained in second pathway 18, possibly liquid soap, to flow from second pathway 18 through holes 66 in ball socket 54, through bore 64, outwardly around the sides of roller ball 70, and out of fourth opening 28. Ball 70 is also able to move downwardly in the opposite direction to arrow "B" to close off fourth opening 28 and stop the flow of the substance from the second pathway 18 to outside dispenser 10. So, the configuration of ball socket 54 is such that ball 70 is loosely retained inside the socket 54 and when ball 70 is pushed upwardly away from fourth opening 28 during use, there is a sufficiently large enough clearance between ball 70 and the interior surfaces of socket 54 to create passageways 76 (FIG. 16) which allow the substance, a liquid soap 74, to flow out of second pathway 18. When ball 70 is in the pushed-up position, fourth opening 28 is in an open position. When upward pressure on ball 70 is released, ball 70 is urged back down in the opposite direction of arrow "B" by spring 68. This movement closes passageways 76 and blocks fourth opening 28. Spring 68 urges ball 70 into a position where fourth opening 28 is blocked unless upward pressure is applied to roller ball 70. Thus, roller assembly 38 is configured to tend not to leak soap 74 from second pathway 18 because spring 68 urges ball 70 into fourth opening 28 until an upward force is applied thereto.

Figure 13:
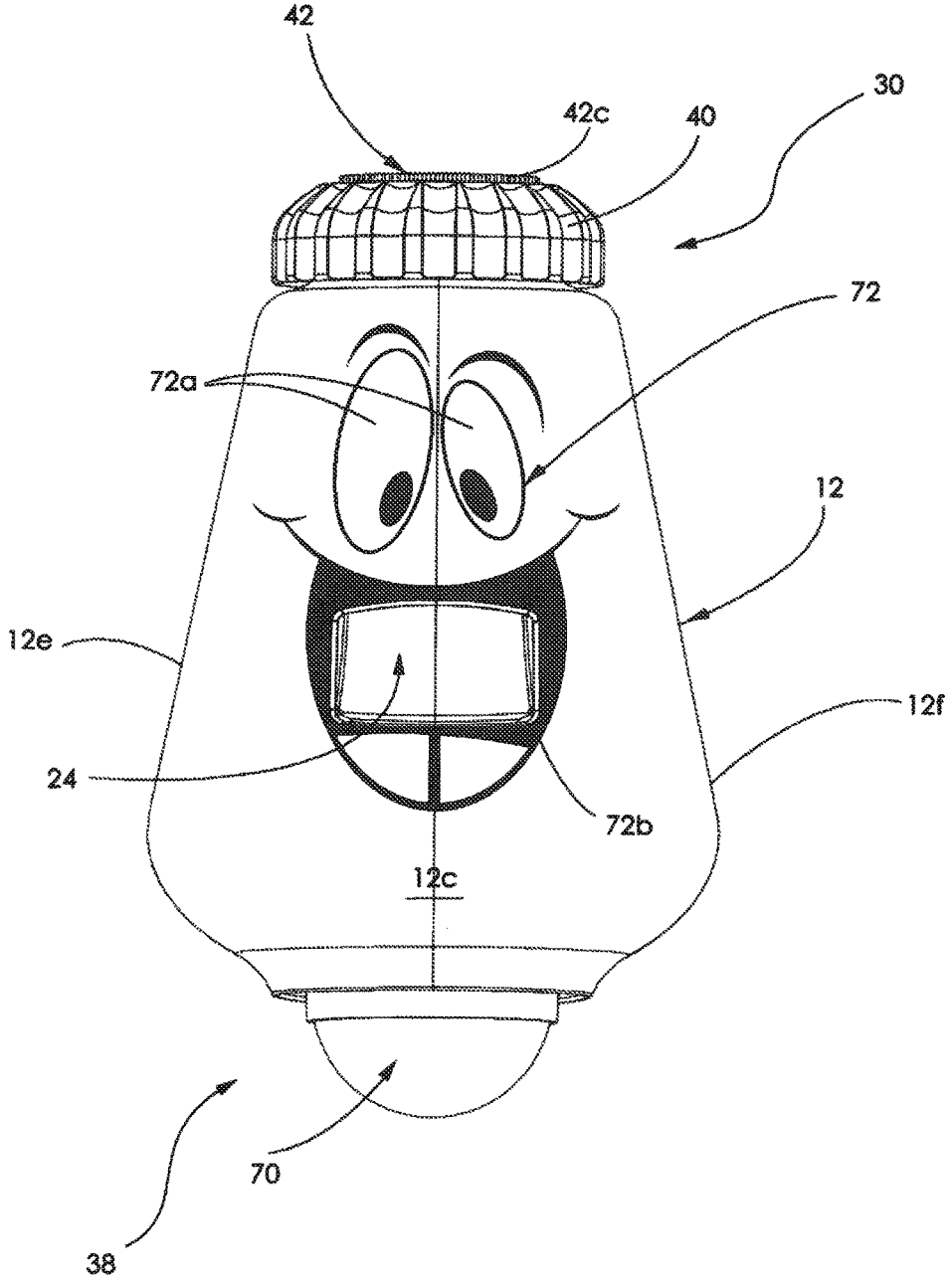
FIG. 13 is a front elevational view of the soap dispenser showing a graphic design imprinted thereon

FIG. 13 shows soap dispenser 10 may include a graphic image 72 on an exterior surface thereof, particularly on the front wall 12*c* as this is the wall facing the user. The graphic image 72 may be of a face that is aesthetically pleasing to children and may include eyes 72*a* and a mouth 72*b*. Mouth 72*b* may be positioned to surround second opening 24 so that it appears that the mouth is on the face and the mouth is in an open condition. Because of this location, when water is caused to flow through dispenser 10, the water flows through the mouth 72*b* in the graphic image and takes on the appearance of a tongue extending out of the mouth. In other words, it may appear to a young child that the cartoon character is sticking their tongue out at the child. The laminar flow of water caused by the trough 20 also aids in creating the illusion of a tongue extending out of dispenser 10.

It will be understood that any of a number of differently configured graphic images 72 that may be aesthetically pleasing and inviting to a child may be provided on the exterior surface of soap dispenser 10. The graphic image 72 of a friendly, cartoon-type face may be provided to encourage younger children to use soap dispenser 10 more frequently. Inasmuch as dispenser 10 is engaged with a faucet 14 and is positioned to dispense both water and soap therefrom, the provision of dispenser 10 aids in teaching younger children to regularly wash their hands as they feel more like they are playing than performing an unwanted chore.

Referring to FIG. 14, soap dispenser 10 is used in the following manner. Faucet 14 may have included an original aerator engaged on threads 14*a*. This original aerator must be removed before dispenser 10 may be engaged with faucet 14.

Dispenser 10 is engaged to faucet 14 by screwing region 42*c* of aerator 42 into an internally threaded aperture 14*a* defined in the end of faucet 14. This is accomplished by rotating connector ring 40 in a first direction indicated by arrow "D" (FIG. 14) as has been previously described herein. The dispenser 10 is thus positioned with first pathway 16 in fluid communication with a pipe, tube or channel 14*b* in faucet 14. Thus, when the faucet 14 is switched on, water will flow in the direction indicated by arrows "C" through channel/pipe 14*b*, through bore 22/42*d* of aerator 42, into first pathway 16 and out of second opening 24. Hot, warm, or cold water may be caused to flow through soap dispenser 10 in this manner. Thus, soap dispenser 10 may dispense only water if that is desired. Water will cease to flow out of second opening 24 when faucet 14 is switched off.

Soap dispenser 10 may also be used to dispense liquid soap. In order to fill dispenser 10 with liquid soap, the entire housing 12 is rotated through 180° (indicated by arrow "D") so that back wall 12*d* now faces the user. In this position, faucet 14 will not interfere with the movement of door 32 on housing 12. Door 32 is pivoted into an open position (shown in phantom in FIG. 14) by pushing downwardly on finger rest 36. Liquid soap 74 is then poured into second pathway 18 through third opening 26 and accumulates within second pathway 18. When a sufficient quantity of liquid soap 74 is retained therein, door 32 is pivoted back to the closed position. Movements of the door 32 between the open and closed position are indicated by arrow "E" in FIG. 14. Housing 12 is then rotated through 180° in the direction opposite to arrow "D" back to the position shown in FIG. 14.

If the user wishes to dispense liquid soap 74 to wash their hands, they simply contact the portion of roller ball 70 extending outwardly from housing 12 and push the same upwardly in the direction of arrow "B". This force moves ball 70 upwardly within the bore 64 of ball socket 54 to the position shown in FIG. 15. The upward movement of ball 70 compresses spring 68. Because fourth opening 28 is no longer blocked, the liquid soap 74 within container tends to want to flow through fourth opening 28 under the force of gravity. Thus, a quantity of liquid soap 74 starts to flow in the direction indicated by arrows "F" around ball 70 and outwardly through passageways 76 opened in ball socket 54 by ball 70 being moved upwardly. Ultimately, the quantity of liquid soap flows out of fourth opening 28 and onto the hands of the user.

As soon as upward pressure is removed from ball 70 by the child withdrawing their hand from contact with ball 70, spring 68 returns to its original shape and position, thus forcing ball 70 downwardly in the opposite direction to arrow "B" and thereby closing off fourth opening 28 and stopping the flow of liquid soap 74 therethrough.

Figure 17:
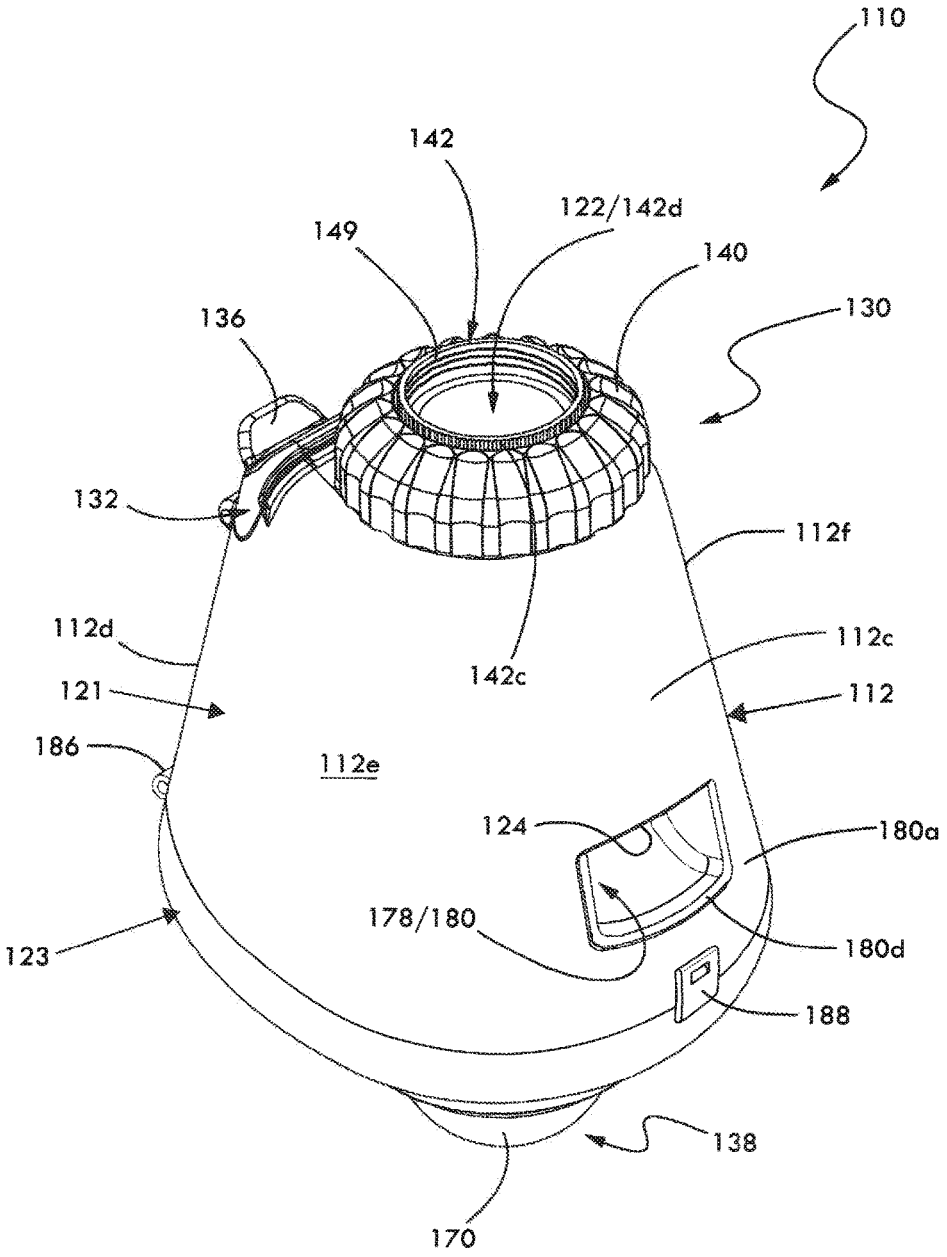
FIG. 17 is a perspective view of a second embodiment of a soap dispenser in accordance with an aspect of the present invention.
Figure 18:
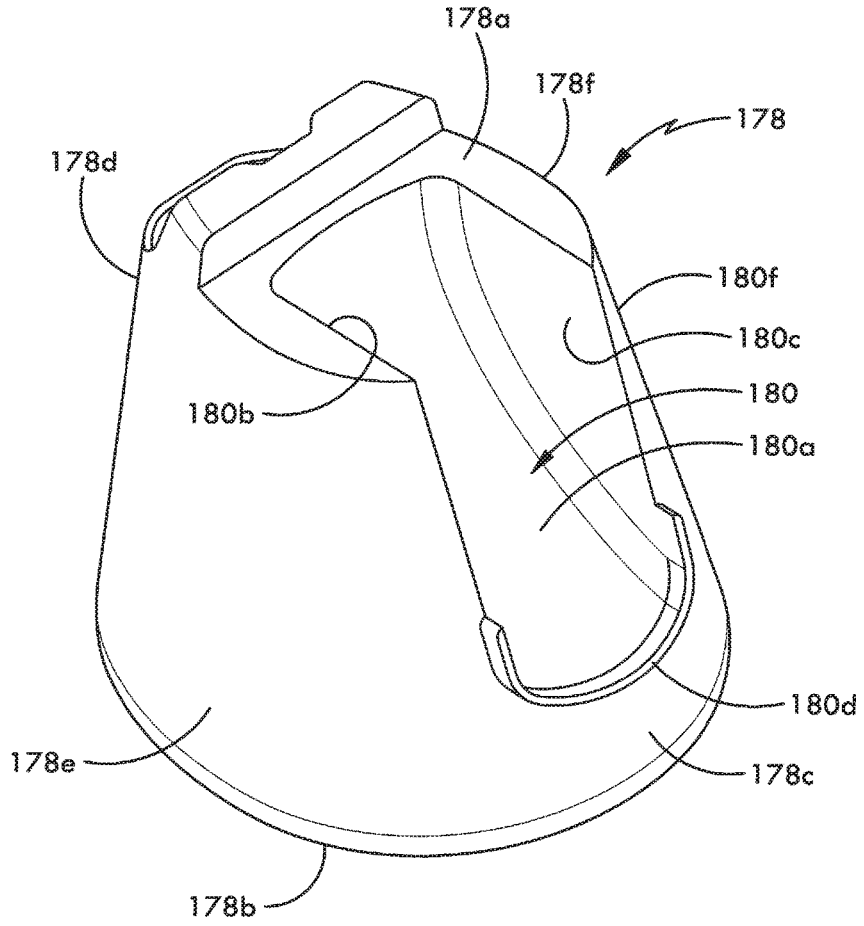
FIG. 18 is a perspective view of a bottle which is received within an interior compartment of the housing of the dispenser.
Figure 19:
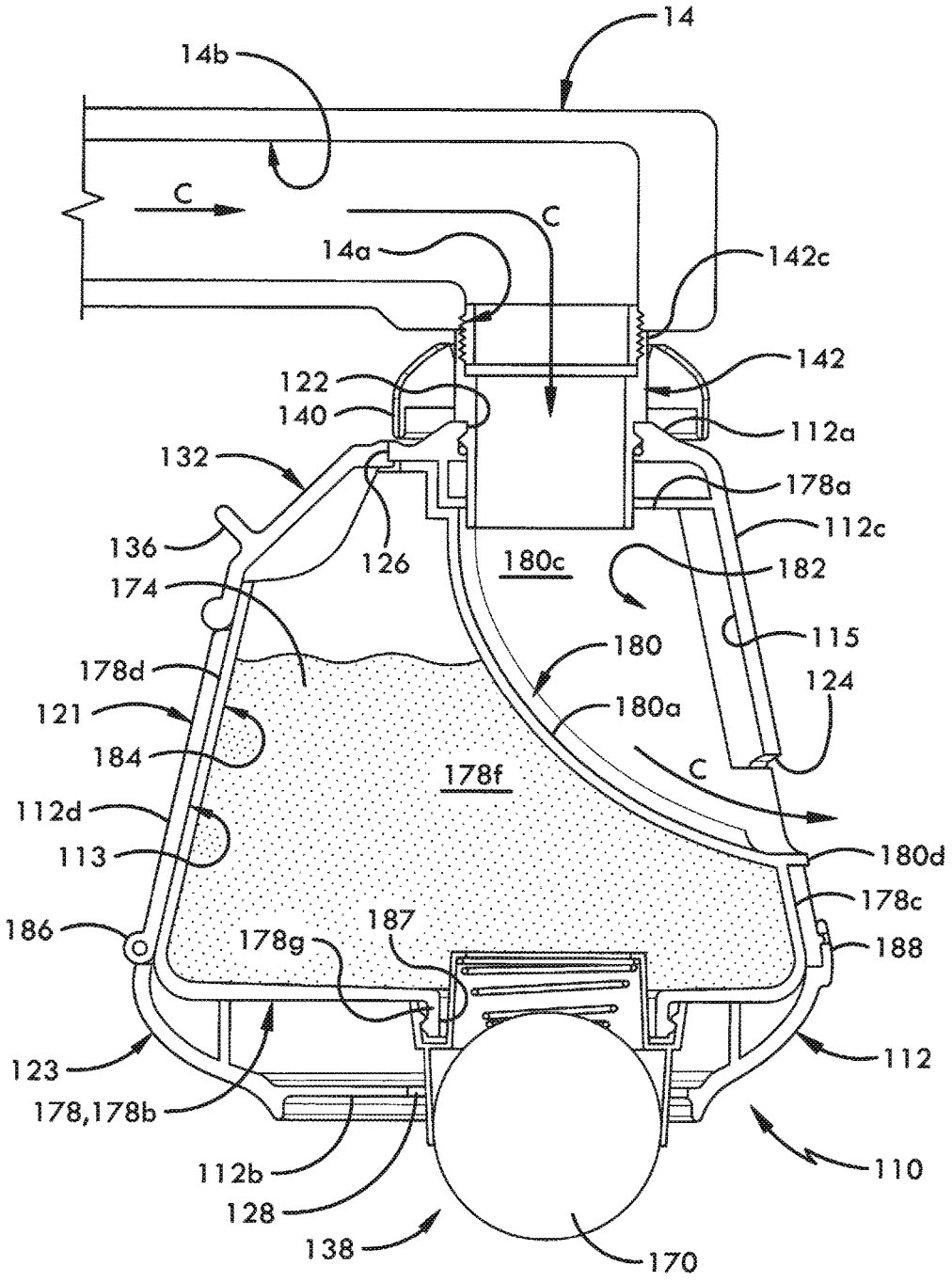
FIG. 19 is a cross-section of the soap dispenser shown in FIG. 17.

FIGS. 17-19 illustrate a second embodiment of a dispenser in accordance with an aspect of the invention, with that dispenser being generally indicated at 110. Dispenser 110 when viewed from the exterior may be substantially similar or identical to dispenser 10. Dispenser 110 may include a housing 112 having a top 112*a*, a bottom 112*b*, a front 112*c*, a back 112*d*, a first side 112*e*, and a second side 112*f*. Housing 112 has a first opening 122 defined therein and a connector assembly 140, 142 is engaged with top 112*a* of housing 112 so that housing 112 may be engaged with a faucet 14 (FIG. 19). The connector assembly 14 may be comprised of a connector ring 140 and an aerator 142. Ring 140 and aerator 142 may be fabricated from brass and have generally the same structure and function as ring 40 and aerator 142. Ring 140 and aerator 142 may also be engaged with housing 112 in a similar manner to the way in which ring 40 and aerator 42 engage housing 12. Aerator 142 may include a region 142*c* which extends upwardly beyond an uppermost portion of ring 140. Aerator 142 may also include interior threads 149 for engaging faucet 14 as illustrated in FIG. 19. A bore 142*d* defined by aerator 142 is in fluid communication with bore 14*b* of faucet 14 when housing 112 is engaged with faucet 14.

Housing 112 may define a second opening 124 in the front wall 112*c*. Second opening 124 is spaced from first opening 122. First and second openings 122, 124 are in fluid communication with each other as will be described below. Housing 112 may also define an additional opening 128 in bottom wall 112*b*. The additional opening 128 is spaced from first and second openings 122, 124 but is not in fluid communication therewith. The purpose of the additional opening 128 will be later described herein.

Housing 112 may further define an opening 126 in rear wall 112*d*. In this instance, opening 126 could be described as the third opening in housing 112 and the additional opening 128 would then be described as the fourth opening in housing 112. If provided, third opening 126 will be in fluid communication with fourth opening 128. A door 132 may selectively close off access to this third opening 126. Door 132 may be substantially similar or identical to door 32 on housing 12 and include a finger rest 136 to move the door 132 between open and closed positions. It will be understood that the opening 126, door 132, and associated structures such as the hinge and finger rest 136 may be completely omitted from housing 112 if third opening 126 is not defined therein.

A roller assembly 138 is provided for controlling access to the interior of housing 112 via the additional or fourth opening 128. The roller assembly includes a roller ball 170 that is movable to selectively allow fluid flow therethrough. The structure and function of roller assembly 138 may be substantially identical to that of roller assembly 38.

The differences between dispenser 110 and dispenser 10 are best seen in FIGS. 18 and 19. In dispenser 110, housing 112 has an exterior wall 115 that defines an interior compartment 113 which is bounded and defined by an interior surface of wall 115. Wall 115 defines the first opening 122, the second opening 124, the third opening 126 (if provided), and the additional or fourth opening 128. In accordance with an aspect of the invention, housing 112 is separated into two parts 121, 123 that are selectively separable so that a bottle 178 may be inserted into or removed from compartment 113. Bottle 178 is complementary shaped and sized to be received within compartment 113. When so received, substantially the entire bottle 178 is located within the compartment 113 and the wall 115 is located outwardly away from an exterior surface of bottle 178.

Bottle 178 has an exterior wall comprising a top wall 178*a*, a bottom wall 178*b*, a front wall 178*c*, a rear wall 178*d*, a first side wall 178*e*, and a second side wall 178*f*. A trough 180 is defined in front wall 178*c* of bottle 178. Trough 180 has a curved first wall 180*a* and two side walls 180*b*, 180*c* that extend upwardly from first wall 180*a*. Trough 180, in conjunction with a portion of the interior surface of wall 115 opposite trough 180, defines a first pathway 182 within dispenser 110. First opening 122 and second opening 124 are in fluid communication with this first pathway 182. Connector assembly 140, 142 places first pathway 182 in fluid communication with bore 14*b* of faucet 14 when housing 112 is secured to faucet 14. Thus, when the faucet is turned on, water is able to flow from out of faucet 14, through bore 142*d* of connector ring and first opening 122, through first pathway 182 and out of second opening 124. A lip 180*d* may be provided at the terminal end of trough 180 as shown in FIG. 18. Lip 180*d* may overlap a portion of front 112*c* of housing 112 when bottle 18 and housing 112 are engaged so as to prevent water sliding down trough 180 from dribbling into compartment 113. It will be understood, however, that lip 180*d* may be omitted from bottle 178. In other instance a seal of some type may be positioned between the terminal end of trough 180 and the interior surface of housing 112 to prevent water from entering compartment 113.

The bottle's exterior wall bounds and defines an interior cavity 184 that is capable of retaining a quantity of liquid soap 174 or any other substance or material as desired. An annular ring 178*g* (FIG. 19) extends outwardly and downwardly from bottom wall 178*b*. Annular ring 178*g* bounds and defines an aperture 187 that is in fluid communication with interior cavity 184. When bottle 178 is received within compartment 113, annular ring 178*g* and thereby aperture 187 are positioned so as to align with fourth opening 128 in housing 112. Interior cavity 184 comprises, a second pathway within dispenser 110.

Roller assembly 138 is engaged with the bottom end of bottle 178. Threads are provided on an exterior surface of annular ring 178*g* and these threads are engaged with mating threads on an upper region of roller assembly 138 to secure roller assembly 138 to bottle 178. When roller assembly 138 is engaged with bottle 178 at least a portion of roller assembly 138 extends through fourth opening 128 and thereby positions roller ball 170 for contact by younger children.

If bottle 178 is a replacement bottle for use with an existing housing 112, then a sealing member (not shown) may be applied over aperture 187 to stop liquid soap 174 from flowing out if aperture 187. Sealing member may comprise a cap or any stick-and-peel type component that is known for sealing bottles.

In accordance with another aspect of the invention, housing 112 may be comprised of two separate parts that are selectively separable from each other so that bottle 178 may be inserted into compartment 113. In FIGS. 17-18 these two separate parts are identified as first part 121 and second part 123. A hinge member 186 may be provided to secure one end of first part 121 to one end of second part 123. Hinge member 186 may therefore permit first and second parts 121, 123 to be pivoted or rotated partly away from each other to open up access to compartment 113 so that bottle 178 may be removed from housing 112 or inserted into the same. Hinge member 186 also enables first and second parts 121, 123 to pivot toward each other to close off access to compartment 113.

In one aspect, soap dispenser 110 may be configured so that the first part 123 is an upper region of housing 112 that includes top 112*a* and the second part 123 is a lower region of housing 112 that includes bottom 112*b*. This bottom region may be secured via hinge(s) 186 to the upper region. This hinged bottom region will effectively become a door that is selectively openable to allow bottle 178 to be slid downwardly and outwardly from housing 112. A replacement bottle 178 may be similarly introduced through an opening in housing 112 that is closed off by way of this door. Hinge 186 or hinges 186 if utilized not only permit first and second parts 121, 123 to move relative to each other but they also ensure that the second part 123 remains engaged with first part 121 and does not drop into the sink. This keeps dispenser 110 more sanitary.

In accordance with another aspect of the invention, one or more latching members 188 may be provided to secure first and second parts 121, 123 together when housing 112 is in the closed position. Latching member(s) may be provided at a location opposed to hinge(s) 186 or at spaced apart locations around the perimeter thereof. So, in the instance described above where a door is formed in housing 112 by a bottom region 123, part of the latching member 188 may be located adjacent a bottom rim of the upper portion 121 of the housing 112 and another part of latching member 188 may be located adjacent an upper rim of the lower portion 123. Latching member 188 may take any one of a number of different forms but most desirably will be of a type that cannot be accidentally (or purposefully) undone by a child.

It will be understood, however, that hinge(s) 186 may be omitted and that first and second parts 121, 123 may be completely separated from each other when it is needful to remove or insert bottle 178. Then, when first and second parts 121, 123 are positioned adjacent and aligned with each other, latching members 188 may be engaged to remain first and second parts 121, 123 in a closed position around bottle 178.

It will also be understood that the size, shape, location and orientation of the first and second parts 121, 123, of the housing 112, the positioning of the hinge member(s) 186 and the latching member(s) 188 may be varied and the specific configuration of housing 112 illustrated in the attached figures is to be taken as an example only. For example, housing 112 may instead be formed by two parts that are halves of the housing such as the halves 11, 13 illustrated in FIG. 10. Still further, instead of two substantially equal halves like 11 and 13, one of the parts may be substantially larger than the other so that the smaller of the two parts may form a door that is substantially vertically oriented instead of horizontally oriented as illustrated in FIGS. 17-19. Any configuration of the housing parts 121, 123 may be utilized including utilizing three or more parts instead of two.

In order to use dispenser 110, a bottle 178 containing liquid soap 174 must be installed within housing 112. Dispenser 112 may be sold as a kit that includes one housing 112 and one or more bottles 178 where each contains a quantity of liquid soap 174. Additional packs of filled bottles may be purchased by the consumer as needed.

The consumer will select one bottle 178 for installation into housing 112. When the user is ready to install bottle 178, the latching member 188 is moved to an unlatched or unlocked position, the first and second parts 121, 123 are separated from each other so that housing 112 is moved from the closed position to the open position. If a hinge 186 is utilized then one of the first and second parts 121, 123 is pivoted away from the other of the first and second parts.

It is then needful to insert bottle 178 into position within a portion of the compartment 113 defined by one or the other parts 121, 123. In this way, when first and second parts 121, 123 are moved toward each other the bottle 178 will be captured within compartment 113. It may be noted that either the first part 121 or the second part 123 may be dimensioned to bound and define a substantial portion of the compartment 113 so that bottle 178 may be seated therein and the other part 121 or 123 is moved to secure bottle 178 within the interior of housing 112.

Since bottle 178 is most likely provided with a sealing member to retain the liquid soap 174 therein, it is needful to remove or pierce that sealing member so that soap may ultimately flow from bottle 178. Additionally, the roller assembly 138 must be engaged with the bottle 178. Both of these operations may be done in any one of a number of ways.

If the bottom region 123 forms a door through which bottles 178 may be inserted or removed as is illustrated in FIGS. 17 and 19, then housing 112 may be engaged with faucet 14 prior to inserting a first bottle 178 into housing 112 or when installing replacement bottles. When bottle is to be engaged with housing 112, the second part 123 of housing 112 is moved away from the first part 121 thereof. Roller assembly 138 is engaged with bottle 178. For example, bottle 178 (which includes a quantity of liquid soap 174 therein) is inverted or partly inverted. The sealing member is then removed from across aperture 18 by pulling a stick-and-peel type tab from the annular ring 178*g*. Liquid soap 174 will not spill out of bottle 178 because bottle 178 is inverted or at least partly inverted. Roller assembly 138 is screwed into engagement with annular ring 178*g* on bottle 178 by engaging the threads on an upper portion of roller assembly 138 (similar to region 60 of roller assembly 38) with the threads on annular ring 178*g*.

Alternatively, instead of removing a stick-and-peel type sealing member from across aperture 187, the upper portion of roller assembly 138 may include a piercing member that punctures the sealing member when roller assembly 138 is threadably engaged with annular ring 178*g* on bottle 178.

Once engaged with bottle 178, the lower portion of roller assembly 138 is inserted through fourth opening 128 in the bottom wall 112*b* of housing 112 so that at least a portion of the lower region thereof extends through fourth aperture 128. First and second parts 121, 123 are moved toward each other again from an open position to a closed position. This motion causes bottom wall 112*b* with bottle 178 seated thereon to move back toward first part 121 so that bottle 178 slides into compartment 113. When bottom wall 112*b* is once again positioned as illustrated in FIG. 19, latching member(s) 188 are engaged to secure first and second parts 121, 123 together. When engaged in this fashion, roller assembly 138 extends outwardly from bottom wall 112*b* of housing 112. During this operation the roller ball 170 is seated in such a way that liquid soap 174 will not flow out of roller assembly 138. It should be noted that when roller ball 174 is pushed upwardly to dispense soap 174, that soap will not flow into compartment 113 but will instead flow out of fourth opening 128. An O-ring or other sealing member may be provided on upper portion 56 of roller assembly 138 or at any other suitable location to prevent any soap 174 to flow from second pathway 184 into compartment 113.

When all of the liquid soap has been drained from bottle 178 the above described steps are reversed. Bottle 178 is removed from housing 112, roller assembly 138 is disengaged therefrom and bottle 178 is thrown away. Roller assembly 138 is engaged with another bottle as described above and then installed into housing 112.

In other instances, roller assembly 138 may comprise a permanent and integral part of bottle 178 instead of being a separate component that gets transferred from the depleted bottle to the replacement bottle. If an integral part of bottle 178, then roller assembly 138 may be in constant fluid communication with second pathway 118 and a sealing member may be applied over the entire roller ball 170 and a lower portion of roller assembly 138 similar to lower portion 58. The sealing member would need to include a limiting component that could prevent roller ball 170 from being accidentally depressed inwardly and thereby inadvertently releasing liquid soap therefrom. The bottle with the integral roller assembly 138 will be inserted into the housing 112 as described above so that the roller assembly 138 extends through the fourth opening 128. The housing 112 will then be closed and the latching member(s) 188 moved from the unlatched position to the latched position. The sealing member covering the roller assembly 138 will then be removed, thereby removing the limiting component and then the dispenser will be ready for use.

It should be noted that if housing 112 is formed from two parts that are halves of the housing (as illustrated in FIG. 10) or are vertically extending component parts, then housing 112 may need to be detached from faucet 14 in order to exchange an empty bottle 178 with a replacement bottle.

Once dispenser 110 is installed on faucet 14 in a similar manner to the way in which dispenser 10 is installed on faucet 14, water may be selectively dispensed therefrom and/or soap may be selectively dispensed therefrom. So a user is able switch on the faucet 14 and water will flow from bore 14*b* of faucet 14, through first opening 122, through first pathway 182 and out of second opening 124. Alternatively, or additionally, a user may apply upward pressure on roller ball 170 and a quantity of the liquid soap 174 in second pathway 184 may be dispensed through aperture 187 and out of second opening 128.

In the above-described instances, bottle 178 is designed to be disposed of once the liquid soap 174 retained therein is depleted. The empty bottle 178 is removed from housing 112 and thrown away and a replacement bottle is inserted into housing 112. In other instances, however, it may be desirable to have a refillable bottle that may be selectively inserted or removed from housing 112. A refillable bottle that may be used with housing 112 will be substantially identical to bottle 178 except the refillable bottle may define a second aperture in top wall 178*a* and or rear wall 178*d*. This second aperture will be positioned to align with third aperture 126 of housing 112. When it is desired to open door 132 to refill bottle 178, the same steps are taken as were taken to refill second pathway 18 of housing 12 except that the newly added liquid soap enters the interior cavity 184 of bottle 178. Rear wall 178*d* may also be shaped to include an indentation to accommodate a portion of the hinge which secures door 132 to housing 112.

Housing 112 of dispenser 110 may be adorned in substantially the same manner as is housing 12 with graphic images of faces appealing to children. Housing 112 may alternatively be molded to include arms and legs or other components which will make dispenser 110 appealing to children.

Thus, there is disclosed herein a method of dispensing soap or water to a user comprising the steps of engaging a dispenser housing 12, 112 onto an end of a faucet 14; positioning a user's hands beneath a bottom wall 12*b*, 112*b* of the dispenser 10, 110 to dispense a quantity of soap into the same; contacting a roller ball 70, 170 extending from the bottom wall 12*b*, 112*b* of the dispenser 10, 110 with the user's hand or hands; pushing the roller ball 70, 170 upwardly toward a top end 12*a*, 112*a* of the housing 12, 112; dispensing a first quantity of soap 74, 174 past the roller ball 70, 170 from a soap-containing pathway 18, 118 defined within the housing 12, 112 and into the user's hands; and moving the user's hands downwardly when sufficient soap has been dispensed into the same.

The method may further comprise the steps of switching on the faucet 14 to dispense a quantity of water from the dispenser 10, 110; positioning the user's hands adjacent an opening 24, 124 in a front wall 12*c*, 112*c* of the dispenser 12, 112; allowing water to flow onto the user's hands from a first pathway 16, 116 in the dispenser; and switching off the faucet 14 when sufficient water has been dispensed therefrom.

The method may further include moving a latching mechanism 188 on the housing 112 from a latched position to an unlatched position; pivoting first and second parts 121, 123 of the housing away from each other; inserting a soap-filled bottle 70 into an interior compartment 113 within one or the other of the first and second parts 121, 123; pivoting the first and second parts 121, 123 of the housing 110 toward each other; engaging latching members 188 and then dispensing a quantity of soap from the dispenser into the user's hands.

Soap dispenser 10, 110 has been disclosed as being configured for use by a young child on a bathroom faucet. It will be understood that soap dispenser 10, 110 could be used in other applications such as engaged on a kitchen faucet. Additionally, soap dispenser 10 could be fabricated with a shape and external appearance, including graphic images 72 that will be more aesthetically pleasing to adults.

It will be further understood that instead of aerator region 42*c*, 142*c* being provided with threads on the exterior surface thereof so that region 42*c*, 142*c* will engage in a threaded aperture of a faucet, the aerator region may instead be provided with threads on an interior surface thereof and be configured to threadably engage an exteriorly threaded faucet.

It will further be understood that this type of dispenser having two distinct and separate pathways may be used in other industries and applications where it is desired to dispense two different substances. In particular, the dispenser may be used in applications where a first substance has to flow readily from the dispenser and the second substance is only used in limited quantities that are dispensed on demand. The substances dispensed by the dispenser described herein need not be limited to liquids but could also include small grains or pellets or the dispenser may dispense one substance that is that liquid in nature and the other substance that is in the form of solid grains or pellets. It will further be understood that more than two pathways could be formed within the housing 10 or more than one bottle 178 could be located within compartment 113 so that dispenser 10, 110 may be able to dispense more than two substances therefrom. An appropriate number of openings will then be provided within housing 12, 112.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the sample embodiment of the invention are an example and the invention is not limited to the exact details shown or described.

The invention claimed is:

1. A soap dispenser comprising:

a housing having a top wall, a bottom wall, a front wall and a rear wall; wherein the front and rear walls extend between the top and bottom walls;

a curved wall provided in an interior of the housing; said curved wall originating in the front wall and curving upwardly towards the top wall;

a first chamber defined within the housing, said first chamber being defined above the curved wall;

a second chamber defined within the housing; said second chamber being defined rearwardly and below the curved wall, wherein the curved wall separates the first chamber from the second chamber;

a first opening defined in the top wall and a second opening defined in the front wall; wherein the first and second openings are in fluid communication with the first chamber;

a connector assembly provided on the housing; said connector assembly circumscribing the first opening; said connector being adapted to secure the housing to a faucet; wherein the curved wall provides a first pathway through the housing along which water flows from the first opening to the second opening when the faucet is switched on.

2. The soap dispenser as defined in claim 1, wherein the curved wall is concave in the first chamber and convex in the second chamber.

3. The soap dispenser as defined in claim 1, further comprising a third opening defined in the housing; said third opening being in fluid communication with the second chamber.

4. The soap dispenser as defined in claim 3, further comprising:

a fourth opening defined in the bottom wall of the housing, said fourth opening being in fluid communication with the second chamber; wherein the second chamber is adapted to retain a quantity of liquid soap therein.

5. The soap dispenser as defined in claim 4, further comprising:

a roller assembly provided to selectively block the fourth opening; wherein the roller assembly is adapted to control a flow of liquid soap from the second chamber.

6. The soap dispenser as defined in claim 5, wherein the roller assembly includes a ball socket; a roller ball that is reciprocally movable within the ball socket; and a spring that is situated between a top wall of the ball socket and the roller ball; and wherein the spring urges the roller ball into a position which closes the fourth opening.

7. The soap dispenser as defined in claim 3, further comprising:

a door pivotally engaged with the housing adjacent the third opening; and wherein the door is movable between a closed position where access to the third opening is prevented; and an open position where access to the third opening is possible.

8. The soap dispenser as defined in claim 1, wherein the curved wall is configured to cause laminar flow of water out of the second opening.

9. The soap dispenser as defined in claim 1, wherein the connector assembly includes an aerator.

10. The soap dispenser as defined in claim 9, wherein the connector assembly further includes a connector ring positioned concentrically around the aerator; and wherein the ring is adapted to be selectively rotated in a first direction to screw the aerator to threads on the faucet or to be rotated in a second direction to unscrew the aerator from threads on the faucet.

11. The soap dispenser as defined in claim 1, further comprising a graphic image provided on an exterior surface of the housing adjacent the second opening; and wherein the graphic image is that of a face and the second opening forms a mouth on the face; and wherein water flowing out of the second opening has the appearance of a tongue extending out of the mouth.

12. A method of dispensing soap or water to a user comprising the steps of:

providing a soap dispenser comprising a housing having a top wall, a bottom wall, a front wall and a rear wall; wherein the front and rear walls extend between the top and bottom walls; a curved wall provided in an interior of the housing; said curved wall originating in the front wall and curving upwardly towards the top wall; a first chamber defined within the housing, said first chamber being defined above the curved wall; a second chamber defined within the housing; said second chamber being defined rearwardly and below the curved wall, wherein the curved wall separates the first chamber from the second chamber; a first opening defined in the top wall, a second opening defined in the front wall; and a third opening defined in the bottom wall; wherein the first and second openings are in fluid communication with the first chamber; and the third opening is in fluid communication with the second chamber and said second chamber contains a quantity of liquid soap; and a connector assembly provided on the housing and circumscribing the first opening;

securing the housing to an end of a faucet using the connector assembly;

positioning a user's hands beneath the third opening in the bottom wall of the dispenser;

contacting a roller ball extending from the bottom wall of the dispenser with the user's hand or hands;

pushing the roller ball upwardly toward a top end of the housing;

dispensing a first quantity of soap past the roller ball from the second chamber defined within the housing and into the user's hands; and moving the user's hands downwardly when sufficient soap has been dispensed into user's hands.

13. The method as defined in claim 12, further comprising the steps of:

switching on the faucet;

causing a quantity of water to flow along the curved wall from the first opening to the second opening;

dispensing the quantity of water from the second opening in the housing;

positioning the user's hands adjacent the second opening in the front wall of the housing;

allowing water to flow onto the user's hands from the second opening; and switching off the faucet when sufficient water has been dispensed therefrom.

* * * * *